US010372048B2

(12) United States Patent
Azuma et al.

(10) Patent No.: US 10,372,048 B2
(45) Date of Patent: Aug. 6, 2019

(54) ELECTROPHOTOGRAPHIC PHOTOSENSITIVE MEMBER

(71) Applicant: KYOCERA Document Solutions Inc., Osaka (JP)

(72) Inventors: Jun Azuma, Osaka (JP); Kensuke Kojima, Osaka (JP); Tomofumi Shimizu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/035,859

(22) Filed: Jul. 16, 2018

(65) Prior Publication Data

US 2019/0025720 A1 Jan. 24, 2019

(30) Foreign Application Priority Data

Jul. 21, 2017 (JP) ..... 2017-141456

(51) Int. Cl.
*G03G 5/06* (2006.01)
*G03G 5/05* (2006.01)

(52) U.S. Cl.
CPC ..... *G03G 5/0618* (2013.01); *G03G 5/056* (2013.01); *G03G 5/0546* (2013.01); *G03G 5/0564* (2013.01); *G03G 5/0609* (2013.01); *G03G 5/0614* (2013.01); *G03G 5/0651* (2013.01); *G03G 5/0677* (2013.01)

(58) Field of Classification Search
CPC .. G03G 5/0618; G03G 5/0614; G03G 5/0609; G03G 5/0651; G03G 5/0564; G03G 5/056
USPC ..... 430/58.75, 59.6, 58.25
See application file for complete search history.

(56) References Cited

U.S. PATENT DOCUMENTS 7,514,191 B2 4/2009 Yanus et al.
7,813,675 B2 * 10/2010 Tanabe ..... G03G 5/043 399/159
8,846,279 B2 * 9/2014 Fujii ..... G03G 5/047 399/159
2007/0254223 A1 11/2007 Yanus et al.
2007/0254226 A1 11/2007 Yanus et al.
2012/0087695 A1 * 4/2012 Nagai ..... G03G 5/047 399/111
2016/0252829 A1 * 9/2016 Kawahara ..... G03G 5/047 430/56
2017/0242352 A1 * 8/2017 Ogaki ..... C08G 63/189

FOREIGN PATENT DOCUMENTS

JP 2007-293342 A 11/2007

* cited by examiner

*Primary Examiner* — Janis L Dote
(74) *Attorney, Agent, or Firm* — Studebaker & Brackett PC

(57) ABSTRACT

An electrophotographic photosensitive member includes a conductive substrate and a photosensitive layer. The photosensitive layer includes a charge generating layer and a charge transport layer. The charge generating layer contains a charge generating material. The charge transport layer contains a hole transport material and a binder resin. The charge transport layer further contains an electron acceptor compound. The hole transport material includes a compound represented by general formula (1). In general formula (1), $R^1$, $R^2$, $R^3$, $R^4$, $R^5$, $R^6$, $R^7$, $R^8$, $R^9$, and $R^{10}$ each represent, independently of one another, a hydrogen atom or a methyl group.

(1)

13 Claims, 1 Drawing Sheet

ELECTROPHOTOGRAPHIC PHOTOSENSITIVE MEMBER

INCORPORATION BY REFERENCE

The present application claims priority under 35 U.S.C. § 119 to Japanese Patent Application No. 2017-141456, filed on Jul. 21, 2017. The contents of this application are incorporated herein by reference in their entirety.

BACKGROUND

The present disclosure relates to an electrophotographic photosensitive member.

An electrophotographic photosensitive member is used as an image bearing member in an electrophotographic image forming apparatus (for example, a printer or a multifunction peripheral). Examples of the image bearing member include an image formation member (image hearing member) including at least one charge transport layer that contains a terphenyl diamine charge transport component of a specific structure. The terphenyl diamine charge transport component is represented by chemical formula (II), for example.

(II)

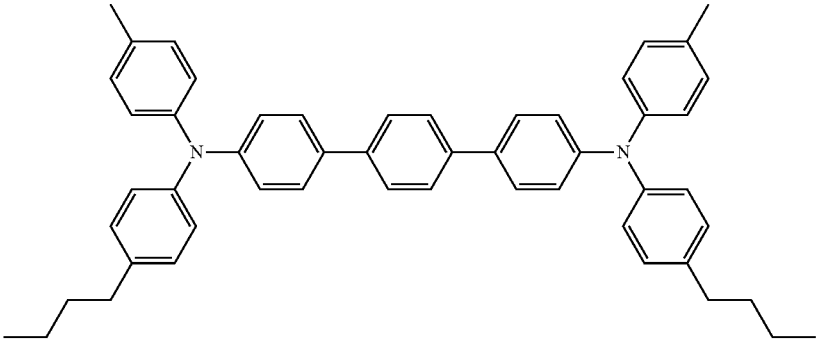

SUMMARY

An electrophotographic photosensitive member according to the present disclosure includes a conductive substrate and a photosensitive layer. The photosensitive layer includes a charge generating layer and a charge transport layer. The charge generating layer contains a charge generating material. The charge transport layer contains a hole transport material and a binder resin. The charge transport layer further contains an electron acceptor compound. The hole transport material includes a compound represented by general formula (1).

(1)

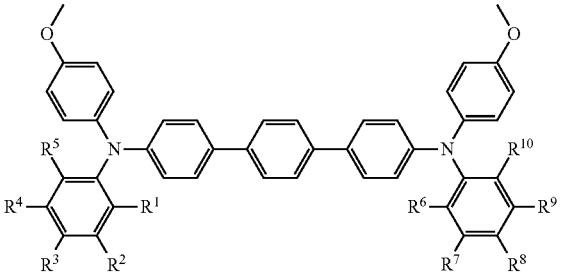

In general formula (1), $R^1$, $R^2$, $R^3$, $R^4$, $R^5$, $R^6$, $R^7$, $R^8$, $R^9$, and $R^{10}$ each represent, independently of one another, a hydrogen atom or a methyl group.

DETAILED DESCRIPTION

Figure 1A:
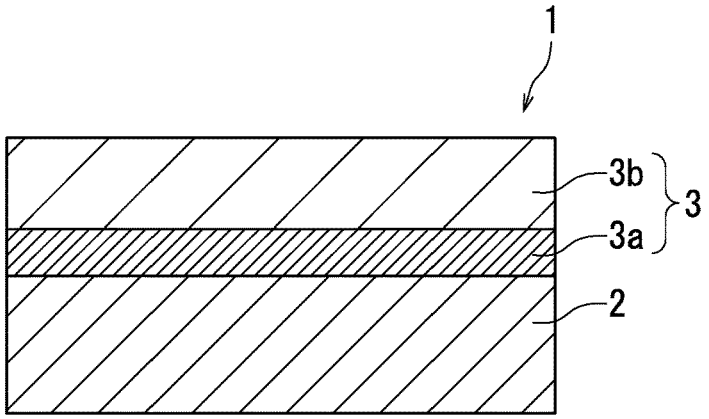
FIGS. 1A, 1B, and 1C are each a partial cross-sectional view illustrating an example of an electrophotographic photosensitive member according to an embodiment of the present disclosure.

The following describes an embodiment of the present disclosure in detail. However, the present disclosure is by no means limited to the following embodiment. The present disclosure can be practiced within a scope of objects of the present disclosure with alterations made as appropriate. Although some overlapping explanations may be omitted as appropriate, such omission does not limit the gist of the present disclosure. In the following description, the term "-based" may be appended to the name of a chemical compound to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. A chemical group "optionally having a chemical group" means a chemical group "optionally substituted by a chemical group". A chemical group "having a chemical group" means a chemical group "substituted by a chemical group". A chemical group "optionally having a halogen atom" means a chemical group "optionally substituted by a halogen atom". A chemical group "having a halogen atom" means a chemical group "substituted by a halogen atom".

In the following description, a halogen atom, an alkyl group having a carbon number of at least 1 and no greater than 6, an alkyl group having a carbon number of at least 1 and no greater than 5, an alkyl group having a carbon number of at least 1 and no greater than 4, an alkyl group having a carbon number of at least 1 and no greater than 3, an alkoxy group having a carbon number of at least 1 and no greater than 6, an alkoxy group having a carbon number of at least 1 and no greater than 3, an aryl group having a carbon number of at least 6 and no greater than 14, an aryl group having a carbon number of at least 6 and no greater than 10, a cycloalkyl group having a carbon number of at least 5 and no greater than 7, a cycloalkylidene group having a carbon number of at least 5 and no greater than 14, a cycloalkylidene group having a carbon number of at least 5 and no greater than 12, an alkoxycarbonyl group having a carbon number of at least 2 and no greater than 7, and an alkoxycarbonyl group having a carbon number of at least 2 and no greater than 6 mean the followings unless otherwise stated.

Examples of halogen atoms (halogen groups) include fluorine atom (fluoro group), chlorine atom (chloro group), bromine atom (bromo group), and iodine atom (iodine group).

Each of alkyl groups having a carbon number of at least 1 and no greater than 6, alkyl groups having a carbon number of at least 1 and no greater than 5, alkyl groups having a carbon number of at least 1 and no greater than 4, and alkyl groups having a carbon number of at least 1 and no greater than 3 is an unsubstituted straight chain or branched chain alkyl group. Examples of alkyl groups having a carbon number of at least 1 and no greater than 6 include methyl group, ethyl group, n-propyl group, isopropyl group, n-butyl group, sec-butyl group, tert-butyl group, n-pentyl group, isopentyl group, neopentyl group, 1,2-dimethylpropyl group, 1-ethyl-1-methylpropyl group, and hexyl group. Examples of alkyl groups having a carbon number of at least 1 and no greater than 5 are groups having a carbon number of at least 1 and no greater than 5 among the above-listed examples of alkyl groups having a carbon number of at least 1 and no greater than 6. Examples of alkyl groups having a carbon number of at least 1 and no greater than 4 are groups having a carbon number of at least 1 and no greater than 4 among the above-listed examples of alkyl groups having a carbon number of at least 1 and no greater than 6. Examples of alkyl groups having a carbon number of at least 1 and no greater than 3 are groups having a carbon number of at least 1 and no greater than 3 among the above-listed examples of alkyl groups having a carbon number of at least 1 and no greater than 6.

Each of alkoxy groups having a carbon number of at least 1 and no greater than 6 and alkoxy groups having a carbon nwnber of at least 1 and no greater than 3 is an unsubstituted straight chain or branched chain alkoxy group. Examples of alkoxy groups having a carbon number of at least 1 and no greater than 6 include methoxy group, ethoxy group, n-propoxy group, isopropoxy group, n-butoxy group, sec-butoxy group, tert-butoxy group, n-pentoxy group, isopentoxy group, neopentoxy group, hexyloxy group, and 1-ethyl-1-methylpropoxy group. Examples of alkoxy groups having a carbon number of at least 1 and no greater than 3 are groups having a carbon number of at least 1 and no greater than 3 among the above-listed examples of alkoxy groups having a carbon number of at least 1 and no greater than 6.

Each of aryl groups having a carbon number of at least 6 and no greater than 14 and aryl groups having a carbon number of at least 6 and no greater than 10 is an unsubstituted aryl group. Examples of aryl groups having a carbon number of at least 6 and no greater than 14 include phenyl group, naphthyl group, indacenyl group, biphenylenyl group, acenaphthylenyl group, anthryl group, and phenanthryl group. Examples of aryl groups having a carbon number of at least 6 and no greater than 10 include phenyl group and naphthyl group.

A cycloalkyl group having a carbon umber of at least 5 and no greater than 7 is an unsubstituted cycloalkyl group. Examples of cycloalkyl groups having a carbon number of at least 5 and no greater than 7 include cyclopentyl group, cyclohexyl group, and cycloheptyl group.

Each of cycloalkylidene groups having a carbon number of at least 5 and no greater than 14 and cycloalkylidene groups having a carbon number of at least 5 and no greater than 12 is an unsubstituted cycloalkylidene group. Examples of cycloalkylidene groups having a carbon number of at least 5 and no greater than 14 include cyclopentylidene group, cyclohexylidene group, cycloheptylidene group, cyclooctylidene group, cyclononylidene group, cyclodecylidene group, cycloundecylidene group, cyclododecylidene group, cyclotridecylidene group, and cyclotetradecylidene group. A cycloalkylidene group having a carbon number of at least 5 and no greater than 14 is represented by a general formula shown below. In the general formula, t represents an integer of at least 1 and no greater than 10 and asterisks each represent a bond. Preferably, t represents an integer of at least 1 and no greater than 8, more preferably 1, 2, or 8, and further preferably 2 or 8.

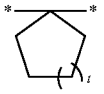

Each of alkoxycarbonyl groups having a carbon number of at least 2 and no greater than 7 and alkoxycarbonyl groups having a carbon number of at least 2 and no greater than 6 is an unsubstituted straight chain or branched chain alkoxycarbonyl group. Alkoxycarbonyl groups having a carbon number of at least 2 and no greater than 7 are carbonyl groups having an alkyl group having a carbon number of at least 1 and no greater than 6. Alkoxycarbonyl groups having a carbon number of at least 2 and no greater than 6 are carbonyl groups having an alkyl group having a carbon number of at least 1 and no greater than 5.

<Electrophotographic Photosensitive Member>

Figure 1B:
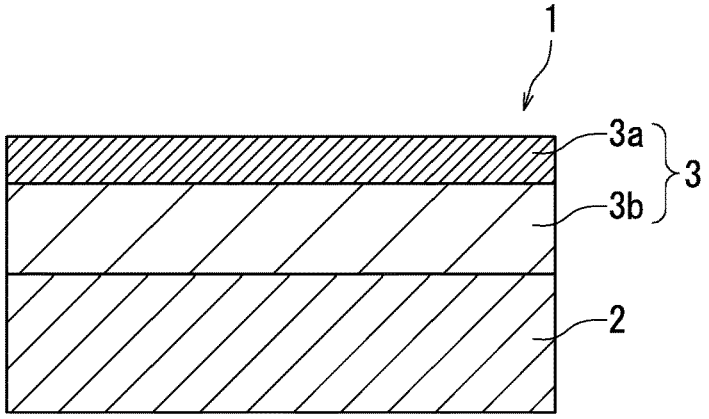
Figure 1C:
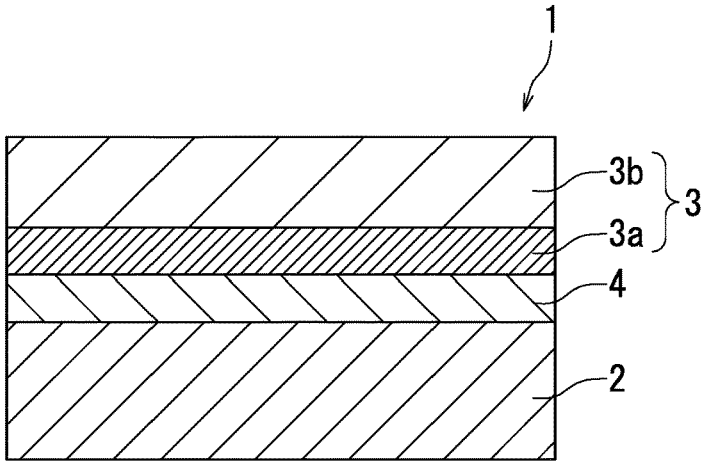

The present embodiment relates to an electrophotographic photosensitive member (hereinafter may be referred to as a photosensitive member). The following describes a photosensitive member 1 of the present embodiment with reference to FIGS. 1A to 1C. FIGS. 1A to 1C are each a partial cross-sectional view illustrating an example of the photosensitive member 1 of the present embodiment.

As illustrated in FIG. 1A, the photosensitive member 1 includes for example a conductive substrate 2 and a photosensitive layer 3. The photosensitive layer 3 includes a charge generating layer 3*a* and a charge transport layer 3*b*. That is, the photosensitive member 1 includes the charge generating layer 3*a* and the charge transport layer 3*b* as the photosensitive layer 3. The photosensitive member 1 is a multi-layer electrophotographic photosensitive member including the charge generating layer 3*a* and the charge transport layer 3*b*.

In order to improve abrasion resistance of the photosensitive member 1, it is preferable that the charge generating layer 3*a* is disposed on the conductive substrate 2 and the charge transport layer 3*b* is disposed on the charge generating layer 3*a* as illustrated in FIG. 1A. However, the photosensitive member 1 may have structure in which the charge transport layer 3*b* is disposed on the conductive substrate 2 and the charge generating layer 3*a* is disposed on the charge transport layer 3*b* as illustrated in FIG. 1B.

The photosensitive member 1 may include the conductive substrate 2, the photosensitive layer 3, and an intermediate layer 4 (undercoat layer) as illustrated in FIG. 1C. The intermediate layer 4 is disposed between the conductive substrate 2 and the photosensitive layer 3. The photosensitive layer 3 may be directly disposed on the conductive substrate 2 as illustrated in FIGS. 1A and 1B. Alternatively, the photosensitive layer 3 may be disposed on the conductive substrate 2 with the intermediate layer 4 therebetween as illustrated in FIG. 1C. Note that a protective layer (not illustrated) may be provided on the photosensitive layer 3.

Although no specific limitation is placed on the thickness of the charge generating layer 3*a*, the thickness thereof is preferably at least 0.01 μm and no greater than 5 μm, and more preferably at least 0.1 μm and no greater than 3 μm. Although no specific limitation is placed on the thickness of the charge transport layer 3*b*, the thickness thereof is preferably at least 2 μm and no greater than 100 μm, and more preferably at least 5 μm and no greater than 50 μm. Through the above, the photosensitive member 1 has been described with reference to FIGS. 1A to 1C. The following further describes the photosensitive member in detail.

<Photosensitive Layer>

The charge generating layer in the photosensitive layer contains a charge generating material. The charge generating layer may contain a binder resin for charge generating layer use (hereinafter may be referred to as a base resin). The charge generating layer may contain an additive as necessary. The charge transport layer in the photosensitive layer contains a hole transport material, a binder resin, and an electron acceptor compound. The charge transport layer may contain an additive as necessary.

(Hole Transport Material)

The hole transport material includes a compound represented by general formula (1) shown below (hereinafter may be referred to as a compound (1)). The photosensitive layer contains the compound (1) as the hole transport material.

(1)

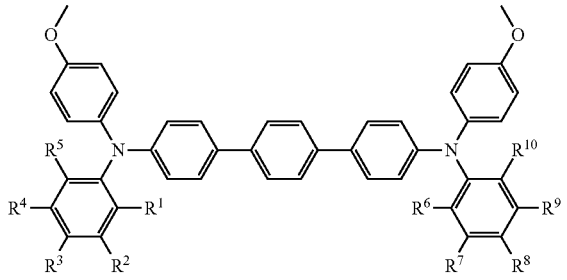

In general formula (1), $R^1$, $R^2$, $R^3$, $R^4$, $R^5$, $R^6$, $R^7$, $R^8$, $R^9$, and $R^{10}$ each represent, independently of one another, a hydrogen atom or a methyl group.

As a result of inclusion of the compound (1) in the photosensitive layer, electrical characteristics of the photosensitive member (for example, sensitivity characteristics and charge characteristics) are improved. Also, crystallization of the photosensitive layer (particularly, the charge transport layer) is inhibited, and oil crack resistance of the photosensitive member is improved. Reasons for the above are supposed as follows.

First, in general formula (1), a methoxy group is bonded to a para position of a phenyl group (hereinafter may be referred to as a phenyl group A) to which $R^1$ to $R^{10}$ are not bonded. As a result, sensitivity characteristics of the photosensitive member are improved, crystallization of the photosensitive layer is inhibited, and oil crack resistance of the photosensitive member is improved. By contrast, when a substituent other than the methoxy group (for example, an alkyl group or a hydrogen atom) is bonded to the para position of the phenyl group A, sensitivity characteristics of the photosensitive member are impaired. Also, when a substituent other than the methoxy group (for example, an alkyl group or a hydrogen atom) is bonded to the para position of the phenyl group A, crystallization of the photosensitive layer cannot be inhibited. Further, when the methoxy group is bonded to a position other than the para position of the phenyl group A (for example, an ortho position or a meta position), sensitivity characteristics of photosensitive member are impaired. Also, when the methoxy group is bonded to a position other than the para position of the phenyl group A (for example, an ortho position or a meta position), oil crack resistance of the photosensitive member lowers.

Second, in general formula (1), hydrogen atoms are bonded to ortho positions and meta positions of the phenyl group A. As a result, sensitivity characteristics of the photosensitive member are improved. By contrast, when a substituent other than a hydrogen atom (for example, an alkyl group) is bonded to at least one of the ortho positions and the meta positions of the phenyl group A, sensitivity characteristics of the photosensitive member deteriorate.

Third, in general formula (1), $R^1$ to $R^{10}$ each represent, independently of one another, a hydrogen atom or a methyl group. As a result, sensitivity characteristics and oil crack resistance of the photosensitive member are improved. By contrast, when $R^1$ to $R^{10}$ represent alkyl groups having a carbon number of at least 2, sensitivity characteristics of the photosensitive member deteriorate. Also, when $R^1$ to $R^{10}$ represent alkyl groups having a carbon number of at least 2, oil crack resistance of the photosensitive member deteriorates.

Preferable examples of the compound (1) include compounds represented by chemical formulas (1-1), (1-2), and (1-3) (hereinafter may be referred to as compounds (1-1), (1-2), and (1-3), respectively).

(1-1)

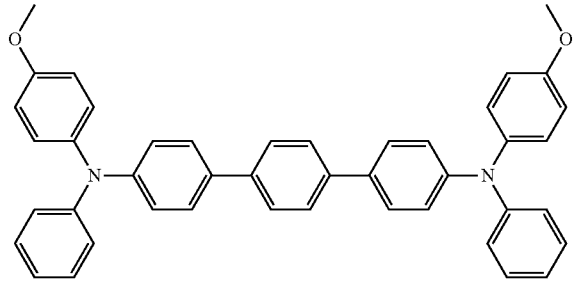

(1-2)

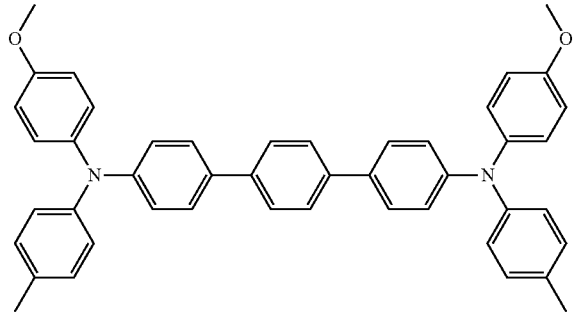

-continued (1-3)

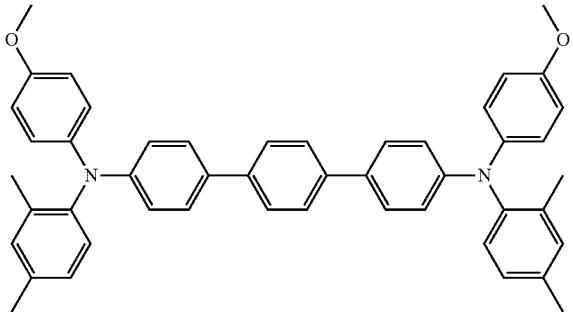

Preferably, a ratio $m_{HTM}/m_{Resin}$ of the mass $m_{HTM}$ of the hole transport material to the mass $m_{Resin}$ of the binder resin is at least 0.50. The ratio $m_{HTM}/m_{Resin}$ is a ratio of the mass $m_{HTM}$ of the hole transport material contained in the charge transport layer to the mass $m_{Resin}$ of the binder resin contained in the charge transport layer. When the ratio $m_{HTM}/m_{Resin}$ is at least 0.50, sensitivity characteristics of the photosensitive member can be further improved. In general, when the ratio $m_{HTM}/m_{Resin}$ is at least 0.50, the amount of the hole transport material is large so that oil cracks (cracks generated due to the presence of oil) tend to be generated in the photosensitive layer. However, the photosensitive member of the present embodiment contains as the hole transport material the compound (1) that is excellent in oil crack resistance. Therefore, even when the ratio $m_{HTM}/m_{Resin}$ is at least 0.50, oil crack resistance of the photosensitive member can be improved. The ratio $m_{HTM}/m_{Resin}$ is preferably at least 0.60, further preferably at least 0.70, and particularly preferably at least 0.80. An upper limit value of the ratio $m_{HTM}/m_{Resin}$ can be set to for example 1.00.

When only the compound (1) is contained as the hole transport material in the photosensitive layer, the mass $m_{HTM}$ of the hole transport material indicates the mass of the compound (1). When two or more hole transport materials are contained in the photosensitive layer, the mass $m_{HTM}$ of the hole transport material indicates a sum of respective masses of the two or more hole transport materials.

When only one binder resin is contained in the photosensitive layer, the mass $m_{Resin}$ of the hinder resin indicates the mass of the one binder resin. When two or more binder resins are contained in the photosensitive layer, the mass $m_{Resin}$ of the binder resin indicates a sum of respective masses of the two or more binder resins.

The charge transport layer may contain only one compound (1) or two or more compounds (1). Also, the charge transport layer may contain only one or more compounds (1) as the hole transport material(s). Alternatively, the charge transport layer may further contain a hole transport material other than the one or more compounds (1) (hereinafter may be referred to as an additional hole transport material) in addition to the compound (1).

Examples of additional hole transport materials that can be used include nitrogen-containing cyclic compounds and condensed polycyclic compounds other than each compound (1). Examples of nitrogen-containing cyclic compounds and condensed polycyclic compounds other than the compound (1) include diamine compounds (specific examples include N,N,N',N'-tetraphenylphenylenediamine derivatives, N,N,N',N'-tetraphenylnaphtylenediamine derivatives, and N,N,N',N'-tetraphenylphenanthrylenediamine derivatives), oxadiazole-based compounds (specific examples include 2,5-di(4-methylaminophenyl)-1,3,4-oxadiazole), styryl compounds (specific examples include 9-(4-diethylaminostyry)anthracene), carbazole compounds specific examples include polyvinyl carbazole), organic polysilane compounds, pyrazoline-based compounds (specific examples include 1-phenyl-3-(p-dimethylaminophenyl)pyrazoline), hydrazone compounds, indole-based compounds, oxazole-based compounds, isoxazole-based compounds, thiazole-based compounds, thiadiazole-based compounds, imidazole-based compounds, pyrazole-based compounds, and triazole-based compounds.

(Binder Resin)

Examples of resins that can be used as the binder resin contained in the charge transport layer include thermoplastic resins, thermosetting resins, and photocurable resins. Examples of thermoplastic resins include polyarylate resin, polycarbonate resin, styrene-butadiene copolymer, styrene-acrylonitrile copolymer, styrene-maleate copolymer, acrylic acid polymer, styrene-acrylate copolymer, polyethylene resin, ethylene-vinyl acetate copolymer, chlorinated polyethylene resin, polyvinyl chloride resin, polypropylene resin, ionomer resin, vinyl chloride-vinyl acetate copolymer, alkyd resin, polyamide resin, urethane resin, polysulfone resin, diallyl phthalate resin, ketone resin, polyvinyl butyral resin, polyester resin, and polyether resin. Examples of thermosetting resins include silicone resin, epoxy resin, phenolic resin, urea resin, and melamine resin. Examples of photocurable resins include acrylic acid adducts of epoxy compounds and acrylic acid adducts of urethane compounds. The photosensitive layer may contain only one of the above-listed binder resins or two or more of the above-listed binder resins.

The binder resin preferably has a viscosity average molecular weight of at least 10,000, more preferably at least 20,000, further preferably at least 30,000, and particularly preferably at least 40,000. When the viscosity average molecular weight of the binder resin is at least 10,000, abrasion resistance of the binder resin is high and the charge transport layer hardly wears down. The binder resin preferably has a viscosity average molecular weight of no greater than 80,000, and more preferably no greater than 70,000. When the viscosity average molecular weight of the binder resin is no greater than 80,000, the binder resin readily dissolves in a solvent for charge transport layer formation to facilitate formation of the charge transport layer.

In order to further improve sensitivity characteristics of the photosensitive member, further inhibit crystallization of the photosensitive layer, and further improve oil crack resistance of the photosensitive member, it is preferable to use a polyarylate resin or a polycarbonate resin as the binder resin.

(Polyarylate Resin)

In order to further improve sensitivity characteristics of the photosensitive member, further inhibit crystallization of the photosensitive layer, and further improve oil crack resistance of the photosensitive member, it is preferable to use a polyarylate resin that includes at least one type of repeating unit represented by general formula (10) and at least one type of repeating unit represented by general formula (11). In the following description, repeating units represented by general formulas (10) and (11) may be referred to as repeating units (10) and (11), respectively.

(10)

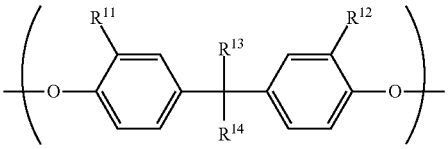

(11)

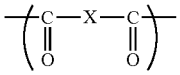

In general formula (10), $R^{11}$ and $R^{12}$ each represent, independently of each other, a hydrogen atom or a methyl group. $R^{13}$ represents a hydrogen atom or an alkyl group having a carbon number of at least 1 and no greater than 4. $R^{14}$ represents an alkyl group having a carbon number of at least 1 and no greater than 4. Alternatively, $R^{13}$ and $R^{14}$ bond together to represent a cycloalkylidene group having a carbon number of at least 5 and no greater than 14.

When the polyarylate resin includes only one type of repeating unit (11), X in general formula (11) represents a divalent group represented by chemical formula (X1).

(X1)

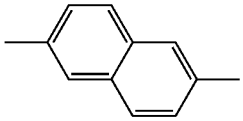

When the polyarylate resin includes at least two types of repeating units (11), X in general formula (11) represents a divalent group represented by chemical formula (X1), (X2), (X3), (X4), (X5), or (X6). In one type of repeating unit (11) among the at least two types of repeating units (11), X in general formula (11) represents a divalent group represented by chemical formula (X1). In the rest of the at least two types of repeating units (11), X in general formula (11) represents a divalent group represented by chemical formula (X2), (X3), (X4), (X5), or (X6).

(X2)

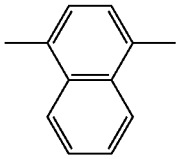

(X3)

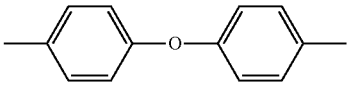

(X4)

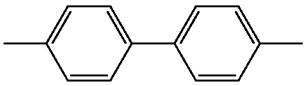

(X5)

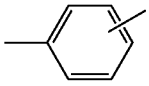

-continued (X6)

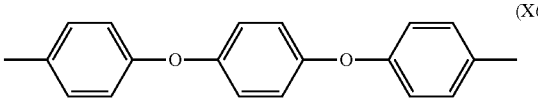

(Repeating Unit (10))

The following describes the repeating unit (10). Preferably, the alkyl group having a carbon number of at least 1 and no greater than 4 represented by either of $R^{13}$ and $R^{14}$ in general formula (10) is a methyl group or an ethyl group.

The cycloalkylidene group having a carbon number of at least 5 and no greater than 14 represented by $R^{13}$ and $R^{14}$ bonded together in general formula (10) is preferably a cycloalkylidene group having a carbon number of at least 5 and no greater than 12, more preferably a cyclopentylidene group, a cyclohexylidene group, or a cyclododecylidene group, and further preferably a cyclohexylidene group or a cyclododecylidene group.

Preferable examples of the repeating unit (10) include repeating units represented by chemical formulas (10-1), (10-2), (10-3), and (10-4). The repeating units represented by chemical formulas (10-1), (10-2), (10-3), and (10-4) may be hereinafter referred to as repeating units (10-1), (10-2), (10-3), and (10-4), respectively. In order to achieve inhibition of crystallization of the photosensitive layer as well as improvement in sensitivity characteristics and oil crack resistance of the photosensitive member, the repeating unit (10) is preferably any of the repeating units (10-1), (10-2), and (10-3).

(10-1)

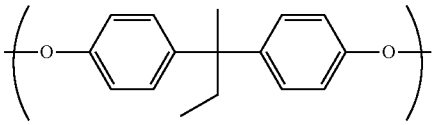

(10-2)

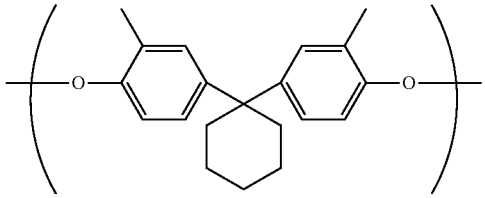

(10-3)

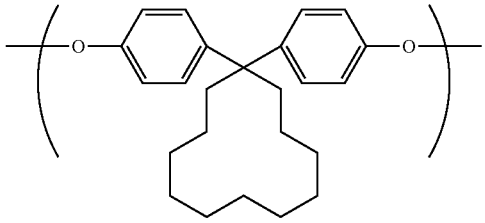

(10-4)

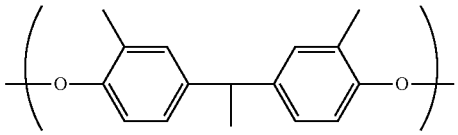

The polyarylate resin may include only one type of repeating unit 10 or at least two types (for example, two or three types) of repeating units (10).

The following describes the repeating unit (11). Specifically, the following describes a configuration in which the polyarylate resin includes only one type of repeating unit (11) and a configuration in which the polyarylate resin includes at least two types of repeating units (11).

(Configuration Including Only One Type of Repeating Unit (11))

In a configuration in which the polyarylate resin includes only one type of repeating unit (11), X in general formula (11) represents a divalent group represented by chemical formula (X1). In this case, the polyarylate resin includes at least one type of repeating unit (10) and a repeating unit represented by chemical formula (11-X1) (hereinafter may be referred to as a repeating unit (11-X1)). In this case, the polyarylate resin preferably includes one type of repeating unit (10) and the repeating unit (11-X1).

(11-X1)

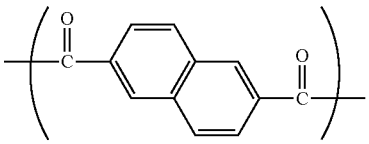

(Configuration Including at Least Two Types of Repeating Units (11))

In a configuration in which the polyarylate resin includes at least two types of repeating units (11), X in general formula (11) represents a divalent group represented by chemical formula (X1), (X2), (X3), (X4), (X5), or (X6). In one type of repeating unit (11) among the at least two types of repeating units (11), X in general formula (11) represents a divalent group represented by chemical formula (X1). In this case, the polyarylate resin includes at least one type of repeating unit (10), the repeating unit (11-X1), and at least one type of repeating unit represented by general formula (11') (hereinafter may be referred to as a repeating unit (11')). In this case, the polyarylate resin preferably includes one type of repeating unit (10), the repeating unit (11-X1), and at least one type of repeating unit (11').

(11-X1)

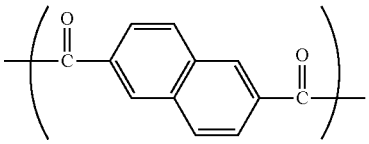

(11')

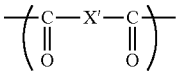

X' in general formula (11') represents a divalent group represented by chemical formula (X2), (X3), (X4), (X5), or (X6). Preferably, X' represents a divalent group represented by chemical formula (X2) or (X3).

Examples of the repeating unit (11') include repeating units represented by chemical formulas (11-X2), (11-X3), (11-X4), (11-X5), and (11-X6) (hereinafter may be referred to as repeating units (11-X2), (11-X3), (11-X4), (11-X5), and (11-X6), respectively). The repeating unit (11') is preferably the repeating unit (11-X2) or (11-X3).

(11-X2)

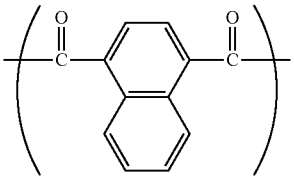

(11-X3)

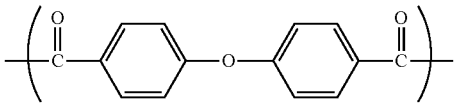

(11-X4)

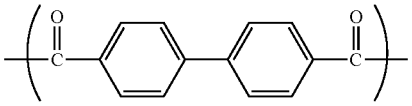

(11-X5)

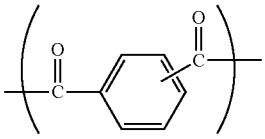

(11-X6)

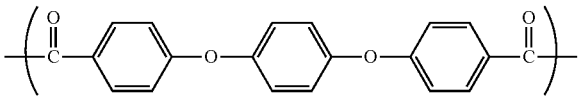

In order to improve sensitivity characteristics of the photosensitive member, inhibit crystallization of the photosensitive layer, and further improve oil crack resistance of the photosensitive member, the polyarylate resin preferably includes at least two types of repeating units (11), more preferably at least two and no more than eight types of repeating units (11), further preferably two or three types of repeating units (11), and particularly preferably two types of repeating units (11).

In order to improve sensitivity characteristics of the photosensitive member, inhibit crystallization of the photosensitive layer, and improve oil crack resistance of the photosensitive member, a ratio of the number of repeating units (11-X1) to a sum of the number of repeating units (11-X1) and the number of repeating units (11') (hereinafter may be referred to as a ratio p) is preferably at least 0.10 and no greater than 0.90, more preferably at least 0.20 and no greater than 0.80, further preferably at least 0.30 and no greater than 0.70, yet more preferably at least 0.40 and no greater than 0.60, and particularly preferably 0.50. The ratio p is not a value calculated for a single molecular chain, but is an average of values calculated for the whole polyarylate resin (a plurality of molecular chains) contained in the charge transport layer. The ratio p can be calculated from a $^{1}$H-NMR spectrum of the polyarylate resin measured using a proton nuclear magnetic resonance spectrometer.

Preferable examples of polyarylate resins including at least one type of repeating unit (10) and at least one type of repeating unit (11) used in order to achieve further inhibition of crystallization of the photosensitive layer as well as improvement in sensitivity characteristics and oil crack resistance of the photosensitive member include: a polyarylate resin including the repeating unit (10-1), the repeating unit (11-X1), and the repeating unit (11-X3); a polyarylate resin including the repeating unit (10-2), the repeating unit (11-X1), and the repeating unit (11-X3); a polyarylate resin including the repeating unit (10-2), the repeating unit (11-X1), and the repeating unit (11-X2); and a polyarylate resin including the repeating unit (10-3), the repeating unit (11-X1), and the repeating unit (11-X3).

(10-1)

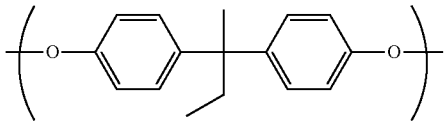

(11-X1)

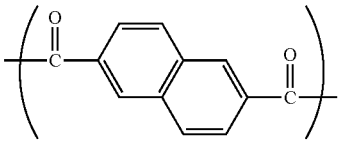

(11-X3)

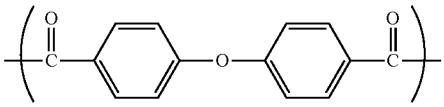

(10-2)

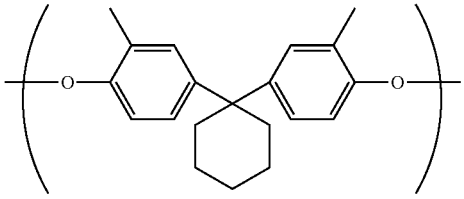

(11-X1)

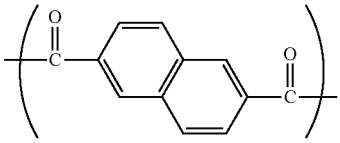

(11-X3)

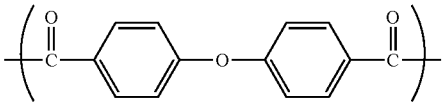

(10-2)

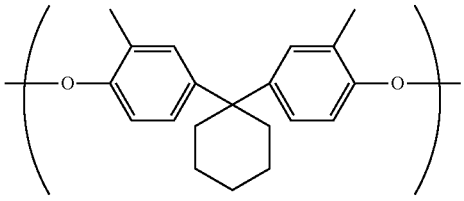

(11-X1)

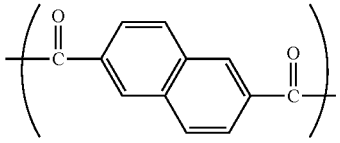

(11-X2)

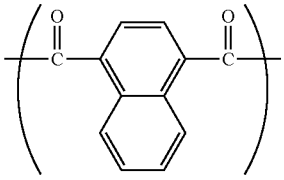

-continued (10-3)

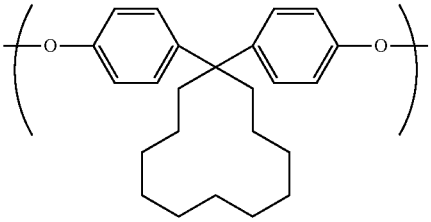

(11-X1)

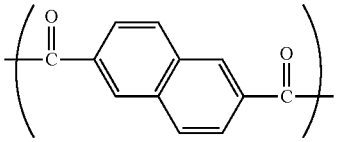

(11-X3)

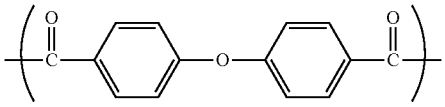

Examples of polyarylate resins including at least one type of repeating unit (10) and at least one type of repeating unit (11) that can be used include a polyarylate resin including the repeating unit (10-4) and the repeating unit (11-X3).

(10-4)

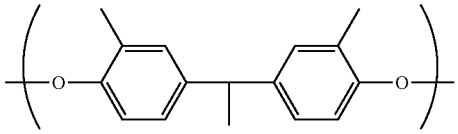

(11-X3)

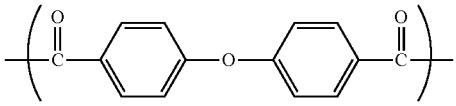

In a polyarylate resin, a repeating unit derived from an aromatic diol and a repeating unit derived from an aromatic dicarboxylic acid are adjacent and bonded to each other. When the polyarylate resin is a copolymer, the polyarylate resin may be for example a random copolymer, an alternating copolymer, a periodic copolymer, or a block copolymer.

Examples of repeating units derived from an aromatic diol include the repeating unit (10). When the polyarylate resin includes at least two types of repeating units (10), no specific limitation is placed on arrangement of one type of repeating unit (10) and the other type(s) of repeating unit (10). The one type of repeating unit (10) and the other type(s) of repeating unit(s) (10) may be arranged randomly, alternately, periodically, or on a block-by-block basis, with the repeating unit (11) interposed therebetween. Examples of repeating units derived from an aromatic dicarboxylic acid include the repeating unit (11). When the polyarylate resin includes at least two types of repeating units (11), no specific limitation is placed on arrangement of one type of repeating unit (11) and the other type(s) of repeating unit(s) (11). The one type of repeating unit (11) and the other type(s) of repeating unit(s) (11) may be arranged randomly, alternately, periodically, or on a block-by-block basis, with the repeating unit (10) interposed therebetween.

The polyatylate resin may include only the repeating units (10) and (11) as repeating units. Alternatively, the polyatylate resin may further include a repeating unit other than e repeating units (10) and (11) in addition to the repeating units (10) and (11).

The charge transport layer may contain, as the binder resin, only one polyarylate resin including at least one type of repeating unit (10) and at least one type of repeating unit (11). Alternatively, the charge transport layer may contain two or more such polyarylate resins as the binder resins. Also, the charge transport layer may further contain, in addition to the polyarylate resin including at least one type of repeating unit (10) and at least one type of repeating unit (11), a binder resin other than the polyarylate resin.

No specific limitation is placed on a method for producing the polyarylate resin. Examples of methods for producing the polyarylate resin include condensation polymerization of an aromatic diol for forming a repeating unit and an aromatic dicarboxylic acid for forming a repeating unit. Any known synthesis method (specific examples include solution polymerization, melt polymerization, and interface polymerization) can be employed for causing condensation polymerization.

Examples of aromatic diols used for forming a repeating unit include at least one compound represented by general formula (BP-10). Examples of aromatic dicarboxylic acids used for forming a repeating unit include at least one compound represented by general formula (DC-11). In general formulas (BP-10) and (DC-11), $R^{11}$, $R^{12}$, $R^{13}$, $R^{14}$, and X represent the same as $R^{11}$, $R^{12}$, $R^{13}$, $R^{14}$ and X in general formulas (10) and (11), respectively. Hereinafter, compounds represented by general formulas (BP-10) and (DC-11) may be referred to as compounds (BP-10) and (DC-11), respectively.

(BP-10)

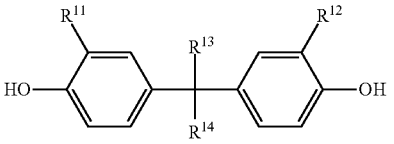

(DC-11)

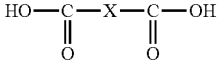

Preferable examples of the compound (BP-10) include compounds represented by chemical formulas (BP-10-1), (BP-10-2), (BP-10-3), and (BP-10-4) (hereinafter may be referred to as compounds (BP-10-1), (BP-10-2), (BP-10-3), and (BP-10-4), respectively).

(BP-10-1)

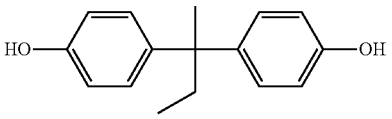

(BP-10-2)

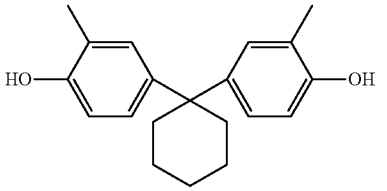

-continued (BP-10-3)

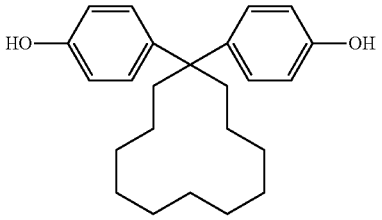

(BP-10-4)

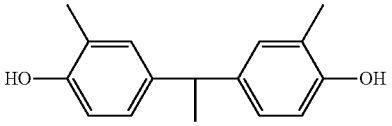

Preferable examples of the compound (DC-11) include compounds represented by chemical formulas (DC-11-X1), (DC-11-X2), (DC-11-X3), (DC-11-X4), (DC-11-X5), and (DC-11-X6) (hereinafter may be referred to as compounds (DC-11-X1), (DC-11-X2), (DC-11-X3), (DC-11-X4), (DC-11-X5), and (DC-11-X6), respectively).

(DC-11-X1)

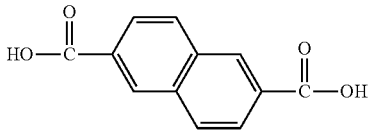

(DC-11-X2)

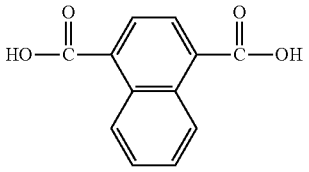

(DC-11-X3)

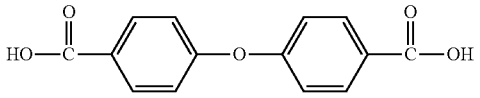

(DC-11-X4)

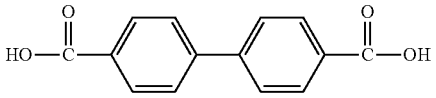

(DC-11-X5)

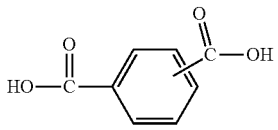

(DC-11-X6)

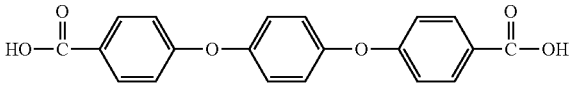

The aromatic diol for forming a repeating unit (for example, the compound (BP-10)) may be converted into an aromatic diacetate for use. The aromatic dicarboxylic acid for forming a repeating unit (for example, the compound (DC-11)) may be derivatized for use. Examples of derivatives of the aromatic dicarboxylic acid include aromatic dicarboxylic acid dichloride, aromatic dicarboxylic acid dimethyl ester, aromatic dicarboxylic acid diethyl ester, and aromatic dicarboxylic acid anhydride. Aromatic dicarboxylic acid dichloride is a compound obtained by substitution of two "—C(=O)—OH" groups in the aromatic dicarboxylic acid each by a "—C(=O)—Cl" group.

In condensation polymerization of the aromatic diol and the aromatic dicarboxylic acid, either or both of a base and a catalyst may be added. The base and the catalyst can be appropriately selected from known bases and known catalysts. Examples of bases include sodium hydroxide. Examples of catalysts include benzyltributylammonium chloride, ammonium chloride, ammonium bromide, quaternary ammonium salt, triethylamine, and trimethylamine. Through the above, the polyarylate resin has been described.

(Polycarbonate Resin)

In order to further improve sensitivity characteristics of the photosensitive member, further inhibit crystallization of the photosensitive layer, and further improve oil crack resistance of the photosensitive member, it is preferable to use a polycarbonate resin including a repeating unit represented by chemical formula (R-5), (R-6), or (R-7). Hereinafter, repeating units represented by chemical formulas (R-5), (R-6), and (R-7) may be referred to as repeating units (R-5), (R-6), and (R-7), respectively.

(R-5)

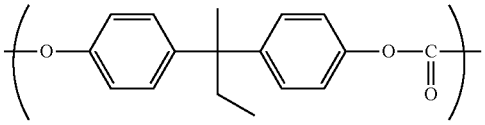

(R-6)

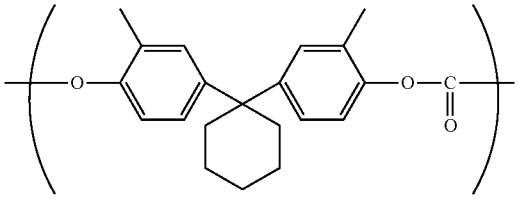

(R-7)

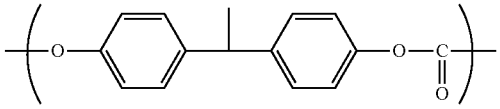

Preferable examples of the polycarbonate resin used in order to achieve inhibition of crystallization of the photosensitive layer and improvement in oil crack resistance of the photosensitive member as well as improvement in sensitivity characteristics of the photosensitive member include a polycarbonate resin including the repeating unit (R-5) and a polycarbonate resin including the repeating unit (R-6).

Only one polycarbonate resin including the repeating unit (R-5), (R-6), or (R-7) may be contained as the binder resin. Alternatively, two or more such polycarbonate resins may be contained as the binder resins. Also, in addition to a polycarbonate resin including the repeating unit (R-5), (R-6), or (R-7), a binder resin other than the polycarbonate resin may be further contained. Through the above, the polycarbonate resin has been described.

(Base Resin)

The charge generating layer contains a base resin. Examples of resins that can be used as the base resin include thermoplastic resins, thermosetting resins, and photocurable resins. Examples of thermoplastic resins include polyarylate resin, polycarbonate resin, styrene-butadiene copolymer, styrene-acrylonitrile copolymer, styrene-maleate copolymer, acrylic acid polymer, styrene-acrylate copolymer, polyethylene resin, ethylene-vinyl acetate copolymer, chlorinated polyethylene resin, polyvinyl chloride resin, polypropylene resin, ionomer resin, vinyl chloride-vinyl acetate copolymer, alkyd resin, polyamide resin, urethane resin, polysulfone resin, diallyl phthalate resin, ketone resin, polyvinyl butyral resin, polyester resin, and polyether resin. Examples of thermosetting resins include silicone resin, epoxy resin, phenolic resin, urea resin, and melamine resin. Examples of photocurable resins include acrylic acid adducts of epoxy compounds and acrylic acid adducts of urethane compounds. The charge generating layer may contain only one of the above-listed base resins or two or more of the above-listed base resins. In order to form the charge generating layer and the charge transport layer favorably, it is preferable that the base resin contained in the charge generating layer differs from the binder resin contained in the charge transport layer.

(Electron Acceptor Compound)

The charge transport layer contains an electron acceptor compound. It is thought that the electron acceptor compound forms a complex with the compound (1) and the formed complex favorably dissolves in a solvent for charge transport layer formation. Therefore, a charge transport layer in which components are uniformly dispersed tends to be formed, resulting in further inhibition of crystallization of the photosensitive layer.

Preferably, a ratio $m_{EA}/m_{HTM}$ of the mass $m_{EA}$ of the electron acceptor compound to the mass $m_{HTM}$ of the hole transport material is at least 0.01 and no greater than 0.50. When the ratio $m_{EA}/m_{HTM}$ is at least 0.01 and no greater than 0.50, further improvement in sensitivity characteristics of the photosensitive member can be achieved as well as improvement in oil crack resistance of the photosensitive member and inhibition of crystallization of the photosensitive layer. In order to achieve further improvement in sensitivity characteristics of the photosensitive member as well as improvement in oil crack resistance of the photosensitive member and inhibition of crystallization of the photosensitive layer, the ratio $m_{EA}/m_{HTM}$ is more preferably at least 0.05, further preferably at least 0.08, and yet more preferably at least 0.10. In order to achieve further improvement in sensitivity characteristics of the photosensitive member as well as improvement in oil crack resistance of the photosensitive member and inhibition of crystallization of the photosensitive layer, the ratio $m_{EA}/m_{HTM}$ is more preferably no greater than 0.30, and further preferably no greater than 0.20. When two or more electron acceptor compounds are contained in the charge transport layer, the mass $m_{EA}$ of the electron acceptor compound indicates a sum of respective masses of the two or more electron acceptor compounds. When two or more hole transport materials are contained in the charge transport layer, the mass $m_{HTM}$ of the hole transport material indicates a sum of respective masses of the two or more hole transport materials.

Examples of electron acceptor compounds include quinone-based compounds, diimide-based compounds, hydrazone-based compounds, malononitrile-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroacridine, succinic anhydride, maleic anhydride, and dibromomaleic anhydride. Examples of quinone-based compounds include diphenoquinone-based compounds, azoquinone-based compounds, anthraquinone-based compounds, naphthoquinone-based compounds, nitroanthraquinone-based compounds, and dinitroanithraquinone-based compounds. Only one electron acceptor compound may be contained or two or more electron acceptor compounds may be contained.

Preferable examples of electron acceptor compounds include compounds represented by general formulas (20), (21), (22), (23), and (24) (hereinafter may be referred to as compounds (20), (21), (22), (23), and (24), respectively). When the compound (20), (21), (22), (23), or (24) is used as the electron acceptor compound, the electron acceptor compound tends to favorably form a complex with the compound (1). The formed complex is thought to favorably dissolve in a solvent for charge transport layer formation. Therefore, a charge transport layer in which components are uniformly dispersed tends to be formed, resulting in further improvement in sensitivity characteristics of the photosensitive member, further inhibition of crystallization of the photosensitive layer, and further improvement in oil crack resistance of the photosensitive member.

(20)

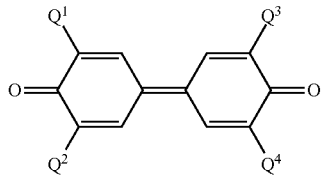

(21)

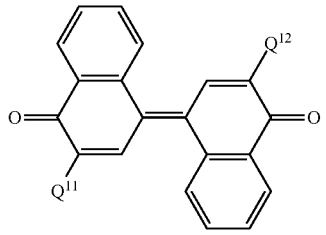

(22)

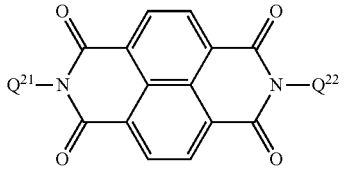

(23)

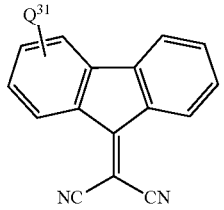

-continued (24)

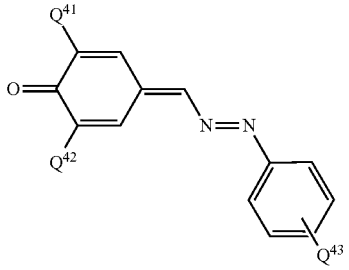

In general formula (20), $Q^1$, $Q^2$, $Q^3$, and $Q^4$ each represent, independently of one another, an alkyl group having a carbon number of at least 1 and no greater than 6, an alkoxy group having a carbon number of at least 1 and no greater than 6, a cycloalkyl group having a carbon number of at least 5 and no greater than 7, or an aryl group having a carbon number of at least 6 and no greater than 14. In general formula (21), $Q^{11}$ and $Q^{12}$ each represent, independently of each other, an alkyl group having a carbon number of at least 1 and no greater than 6, an alkoxy group having a carbon number of at least 1 and no greater than 6, a cycloalkyl group having a carbon number of at least 5 and no greater than 7, or an aryl group having a carbon number of at least 6 and no greater than 14. In general formula (22), $Q^{21}$ and $Q^{22}$ each represent, independently of each other, an aryl group having a carbon number of at least 6 and no greater than 14 and optionally having an alkyl group having a carbon number of at least 1 and no greater than 6 or an alkoxy group having a carbon number of at least 1 and no greater than 6. In general formula (23), $Q^{31}$ represents an alkoxvcarbonvl group having a carbon number of at least 2 and no greater than 7. In general formula (24), $Q^{41}$ and $Q^{42}$ each represent, independently of each other, an alkyl group having a carbon number of at least 1 and no greater than 6, and $Q^{43}$ represents a halogen atom.

The alkyl group having a carbon number of at least 1 and no greater than 6 represented by any of $Q^1$, $Q^2$, $Q^3$, and $Q^4$ in general formula (20), $Q^{11}$ and $Q^{12}$ in general formula (21), and $Q^{41}$ and $Q^{42}$ in general formula (24) is preferably a methyl group, an ethyl group, a butyl group, or a hexyl group, and more preferably a methyl group, a tert-butyl group, or a 1-ethyl-1-methylpropyl group.

The alkoxy group having a carbon number of at least 1 and no greater than 6 represented by any of $Q^1$, $Q^2$, $Q^3$, and $Q^4$ in general formula (20) and $Q^{11}$ and $Q^{12}$ in general formula (21) is preferably an alkoxy group having a carbon number of at least 1 and no greater than 3.

The cycloalkyl group having a carbon number of at least 5 and no greater than 7 represented by any of $Q^1$, $Q^2$, $Q^3$, and $Q^4$ in general formula (20) and $Q^{11}$ and $Q^{12}$ in general formula (21) is preferably a cyclohexyl group.

The aryl group having a carbon number of at least 6 and no greater than 14 represented by any of $Q^1$, $Q^2$, $Q^3$, and $Q^4$ in general formula (20), $Q^{11}$ and $Q^{12}$ in general formula (21), and $Q^{21}$ and $Q^{22}$ in general formula (22) is preferably an aryl group having a carbon number of at least 6 and no greater than 10, and more preferably a phenyl group.

The aryl group having a carbon number of at least 6 and no greater than 14 represented by either of $Q^{21}$ and $Q^{22}$ in general formula (22) optionally has, as a substituent, an alkyl group having a carbon number of at least 1 and no greater than 6 or an alkoxy group having a carbon number of at least 1 and no greater than 6. The above substituent is preferably an alkyl group having a carbon number of at least 1 and no greater than 6, more preferably an alkyl group having a carbon number of at least 1 and no greater than 3, and further preferably a methyl group or an ethyl group. The number of substituents (specifically, each being an alkyl group having a carbon number of at least 1 and no greater than 6 or an alkoxy group having a carbon number of at least 1 and no greater than 6) in the aryl group having a carbon number of at least 6 and no greater than 14 represented by either of $Q^{21}$ and $Q^{22}$ is preferably at least 1 and no greater than 3, and more preferably 2.

The alkoxycarbonyl group having a carbon number of at least 2 and no greater than 7 represented by $Q^{31}$ in general formula (23) is preferably a butoxycarbonyl group, and more preferably an n-butoxycarbonyl group.

The halogen atom represented by $Q^{43}$ in general formula (24) is preferably a chlorine atom or a fluorine atom, and more preferably a chlorine atom.

In general formula (20), $Q^1$, $Q^2$, $Q^3$, and $Q^4$ each preferably represent, independently of one another, an alkyl group having a carbon number of at least 1 and no greater than 6. In general formula (21), $Q^{11}$ and $Q^{12}$ each preferably represent, independently of each other, an alkyl group having a carbon number of at least 1 and no greater than 6. In general formula (22), $Q^{21}$ and $Q^{22}$ each preferably represent, independently of each other, an aryl group having a carbon number of at least 6 and no greater than 14 and having an alkyl group having a carbon number of at least 1 and no greater than 6. In general formula (23), $Q^{31}$ preferably represents an alkoxycarbonyl group having a carbon number of at least 2 and no greater than 6. In general formula (24), $Q^{41}$ and $Q^{42}$ each preferably represent, independently of each other, an alkyl group having a carbon number of at least 1 and no greater than 4, and $Q^{43}$ preferably represents a chlorine atom.

Preferable examples of electron acceptor compounds include compounds represented by chemical formulas (20-E1), (20-E2), (21-E3), (22-E4), (23-E5), and (24-E6) (hereinafter may be referred to as compounds (20-E1), (20-E2), (21-E3), (22-E4), (23-E5), and (24-E6), respectively). Preferable examples of the compound (20) include the compounds (20-E1) and (20-E2). Preferable examples of the compound (21) include the compound (21-E3). Preferable examples of the compound (22) include the compound (22-E4). Preferable examples of the compound (23) include the compound (23-E5). Preferable examples of the compound (24) include the compound (24-E6).

(20-E1)

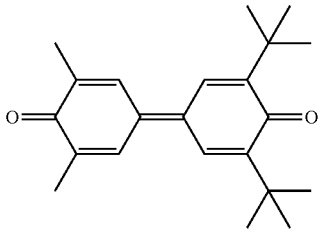

(20-E2)

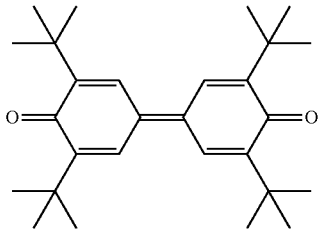

-continued (21-E3)

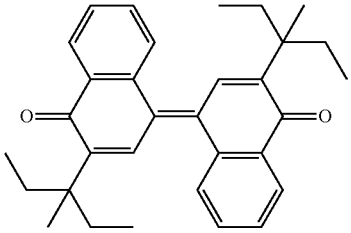

(22-E4)

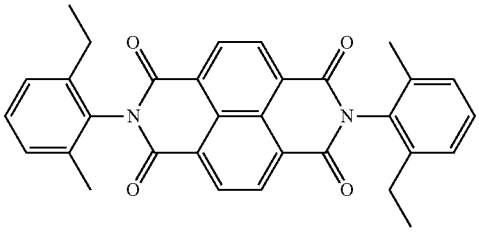

(23-E5)

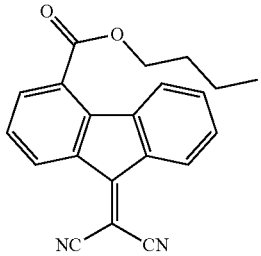

(24-E6)

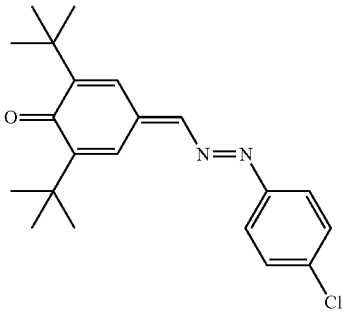

The charge transport layer may contain only one of the compounds (20), (21), (22), (23), and (24) as the electron acceptor compound, or two or more of these compounds as the electron acceptor compounds. The charge transport layer may contain an electron acceptor compound other than the compounds (20) to (24) in addition to one or more of the compounds (20) to (24).

Also, the charge transport layer may contain only one of the compounds (20-E1), (20-E2), (21-E3), (22-E4), (23-E5), and (24-E6) as the electron acceptor compound, or two or more of these compounds as the electron acceptor compounds. The charge transport layer may contain an electron acceptor compound other than the compounds (20-E1), (20-E2), (21-E3), (22-E4), (23-E5), and (24-E6) in addition to one or more of the compounds (20-E1), (20-E2), (21-E3), (22-E4), (23-E5), and (24-E6).

(Charge Generating Material)

Examples of charge generating materials include phthalocyanine-based pigments, perylene-based pigments, bisazo pigments, tris-azo pigments, dithioketopyrrolopyrrole pigments, metal-free naphthalocyanine pigments, metal naphthalocyanine pigments, squaraine pigments, indigo pigments, azulenium pigments, cyanine pigments, powders of inorganic photoconductive materials (specific examples include selenium, selenium-tellurium, selenium-arsenic, cadmium sulfide, and amorphous silicon), pyrylium pigments, anthanthrone-based pigments, triphenylmethane-based pigments, threne-based pigments, toluidine-based pigments, pyrazoline-based pigments, and quinacridone-based pigments. The charge transport layer may contain only one of the above-listed charge generating materials or two or more of the above-listed charge generating materials.

Examples of phthalocyanine-based pigments include metal-free phthalocyanine and metal phthalocyanine. Examples of metal phthalocyanine include titanyl phthalocyanine, hydroxygallium phthalocyanine, and chlorogallium phthalocyanine. Metal-free phthalocyanine is represented by chemical formula (CGM-1). Titanyl phthalocyanine is represented by chemical formula (CGM-2).

(CGM-1)

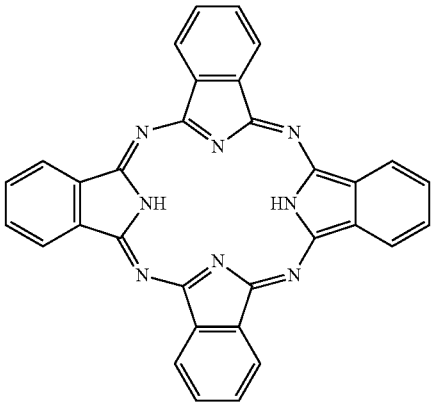

(CGM-2)

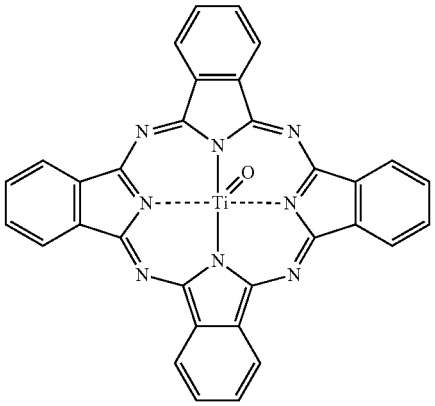

Phthalocyanine-based pigments may be crystalline or non-crystalline. Examples of crystalline metal-free phthalocyanine include metal-free phthalocyanine having X-form crystal structure (hereinafter may be referred to as X-form metal-free phthalocyanine). Examples of crystalline titanyl phthalocyanine include titanyl phthalocyanine having α-form, β-form, and Y-form crystal structure (hereinafter may be referred to as α-form titanyl phthalocyanine, β-form titanyl phthalocyanine, and Y-form titanyl phthalocyanine, respectively).

For example, in image forming apparatuses of digital optical system (specific examples include a laser beam printer or a facsimile machine using a light source such as a semiconductor laser), a photosensitive member having sensitivity within a wavelength range of 700 nm or longer is preferably used. As a charge generating material, a phthalocyanine-based pigment is preferable in terms of its high quantum yield within a wavelength range of 700 nm or longer. Metal-free phthalocyanine or titanyl phthalocyanine is more preferable. X-form metal-free phthalocyanine or Y-form titanyl phthalocyanine is further preferable. Y-form titanyl phthalocyanine is particularly preferable.

In a photosensitive member used in an image forming apparatus including a short-wavelength laser light source (for example, a laser light source having a wavelength of at least 350 nm and no greater than 550 nm), an anthanthrone-based pigment is favorably used as a charge generating material.

The amount of the charge generating material is preferably at least 0.1 parts by mass and no greater than 50 parts by mass relative to 100 parts by mass of the base resin contained in the charge generating layer, more preferably at least 0.5 parts by mass and no greater than 30 parts by mass, and particularly preferably at least 0.5 parts by mass and no greater than 4.5 parts by mass.

(Additive)

Examples of additives that may be contained in either or both of the charge generating layer and the charge transport layer include antidegradants (specific examples include antioxidants, radical scavengers, singlet quenchers, and ultraviolet absorbing agents), softeners, surface modifiers, extenders, thickeners, dispersion stabilizers, waxes, donors, surfactants, plasticizers, sensitizers, and leveling agents. Examples of antioxidants include hindered phenol (specific examples include di(tert-butyl)p-cresol), hindered amine, paraphenylenediamine, arylalkane, hydroquinone, spirochromane, spiroindanone, and derivatives thereof. Other examples of antioxidants include organosulfur compounds and organophosphorus compounds. Examples of leveling agents include dimethyl silicone oil. Examples of sensitizers include meta-terphenyl.

(Combination of Materials)

In order to further improve sensitivity characteristics of the photosensitive member, further inhibit crystallization of the photosensitive layer, and further improve oil crack resistance of the photosensitive member, the following combinations of hole transport materials, binder resins, and electron acceptor compounds are preferable. Also, it is more preferable to use Y-form titanyl phthalocyanine as the charge venerating material and employ any of the following combinations of hole transport materials, binder resins, and electron acceptor compounds.

The hole transport material is the compound (1-1); the binder resin is a polyarylate resin including the repealing unit (10-1), the repeating unit (11-X1), and the repeating unit (11-X3); and the electron acceptor compound is the compound (20-E1), (20-E2), (21-E3), (22-E4), (23-E5), or (24-E6).

The hole transport material is the compound (1-2); the binder resin is a polyarylate resin including the repealing unit (10-1), the repeating unit (11-X1), and the repeating unit (11-X3); and the electron acceptor compound is the compound (20-E1), (20-E2), (21-E3), (22-E4), (23-E5), or (24-E6).

The hole transport material is the compound (1-3); the binder resin is a polyarylate resin including the repeating unit (10-1), the repeating unit (11-X1), and the repeating unit (11-X3); and the electron acceptor compound is the compound (20-E1), (20-E2), (21-1E3), (22-E4), (23-E5), or (24-1E6).

The hole transport material is the compound (1-1); the binder resin is a polyarylate resin including the repeating unit (10-2), the repeating unit (11-X1), and the repeating unit (11-X3); and the electron acceptor compound is the compound (20-E1), (20-E2), (21-1E3), (22-E4), (23-E5), or (24-1E6).

The hole transport material is the compound (1-2); the binder resin is a polyarylate resin including the repeating unit (10-2), the repeating unit (11-X1), and the repeating unit (11-X3); and the electron acceptor compound is the compound (20-E1), (20-E2), (21-E3), (22-E4), (23-E5), or (24-E6).

The hole transport material is the compound (1-3); the binder resin is a polyarylate resin including the repeating unit (10-2), the repeating unit (11-X1), and the repeating unit (11-X3); and the electron acceptor compound is the compound (20-E1, (20-E2), (21-E3), (22-E4), (23-E5), or (24-E6).

The hole transport material is the compound (1-1); the binder resin is a polyarylate resin including the repeating unit (10-2), the repeating unit (11-X1), and the repeating unit (11-X2); and the electron acceptor compound is the compound (20-E1), (20-E2), (21-E3), (22-E4), (23-E5), or (24-E6).

The hole transport material is the compound (1-2); the binder resin is a polyarylate resin including the repeating unit (10-2), the repeating unit (11-X1), and the repeating unit (11-X2); and the electron acceptor compound is the compound (20-E1), (20-E2), (21-E3), (22-E4), (23-E5), or (24-E6).

The hole transport material is the compound (1-3); the binder resin is a polyarylate resin including the repeating unit (10-2), the repeating unit (11-X1), and the repeating unit (11-X2); and the electron acceptor compound is the compound (20-E1), (20-E2), (21-E3), (22-E4), (23-E5), or (24-E6).

The hole transport material is the compound (1-1); the binder resin is a polyarylate resin including the repeating unit (10-3), the repeating unit (11-X1), and the repeating unit (11-X3); and the electron acceptor compound is the compound (20-E1), (20-E2), (21-E3), (22-E4), (23-E5), or (24-E6).

The hole transport material is the compound (1-2); the hinder resin is a polyarylate resin including the repeating unit (10-3), the repeating unit (11-X1), and the repeating unit (11-X3); and the electron acceptor compound is the compound (20-E1), (20-E2), (21-E3), (22-E4), (23-E5), or (24-E6).

The hole transport material is the compound (1-3); the binder resin is a polyarylate resin including the repeating unit (10-3), the repeating unit (11-X1), and the repeating unit (11-X3); and the electron acceptor compound is the compound (20-E1), (20-E2), (21-E3), (22-E4), (23-E5), or (24-E6).

The hole transport material is the compound (1-1); the binder resin is a polyarylate resin including the repeating unit (10-4) and the repeating unit (11-X3); and the electron acceptor compound is the compound (20-E1), (20-E2), (21-E3), (22-E4), (23-E5), or (24-E6).

The hole transport material is the compound (1-2); the binder resin is a polyarylate resin including the repeating unit (10-4) and the repeating unit (11-X3); and the electron acceptor compound is the compound (20-E1), (20-E2), (21-E3), (22-E4), (23-E5), or (24-E6).

The hole transport material is the compound (1-3); the binder resin is a polyarylate resin including the repealing unit (10-4) and the repeating unit (11-X3); and the electron acceptor compound is the compound (20-E1), (20-E2), (21-E3), (22-E4), (23-E5), or (24-E6).

The hole transport material is the compound (1-1); the binder resin is a polycarbonate resin including the repeating unit (R-5); and the electron acceptor compound is the compound (20-E1), (20-E2), (21-E3), (22-E4), (23-E5), or (24-E6).

The hole transport material is the compound (1-2); the binder resin is a polycarbonate resin including the repeating unit (R-5); and the electron acceptor compound is the compound (20-E1), (20-E2), (21-E3), (22-E4), (23-E5), or (24-E6).

The hole transport material is the compound (1-3); the binder resin is a polycarbonate resin including the repeating unit (R-5); and the electron acceptor compound is the compound (20-E1), (20-E2), (21-E3), (22-E4), (23-E5), or (24-E6).

The hole transport material is the compound (1-1); the binder resin is a polycarbonate resin including the repeating unit (R-6); and the electron acceptor compound is the compound (20-E1), (20-E2), (21-E3), (22-E4), (23-E5), or (24-E6).

The hole transport material is the compound (1-2); the hinder resin is a polycarbonate resin including the repeating unit (R-6); and the electron acceptor compound is the compound (20-E1), (20-E2), (21-E3), (22-E4), (23-E5), or (24-E6).

The hole transport material is the compound (1-3); the binder resin is a polycarbonate resin including the repeating unit (R-6); and the electron acceptor compound is the compound (20-E1), (20-E2), (21-E3), (22-E4), (23-E5), or (24-E6).

The hole transport material is the compound (1-1) the binder resin is a polycarbonate resin including the repeating unit (R-7); and the electron acceptor compound is the compound (20-E1), (20-E2), (21-E3), (22-E4), (23-E5), or (24-E6).

The hole transport material is the compound (1-2); the binder resin is a polycarbonate resin including the repeating unit (R-7); and the electron acceptor compound is the compound (20-E1), (20-E2), (21-E3), (22-E4), (23-E5), or (24-E6).

The hole transport material is the compound (1-3); the binder resin is a polycarbonate resin including the repeating unit (R-7); and the electron acceptor compound is the compound (20-E1), (20-E2), (21-E3), (22-E4), (23-E5), or (24-E6).

<Conductive Substrate>

No specific limitation is placed on the conductive substrate as long as the conductive substrate can be used in a photosensitive member. It is only required that at least a surface portion of the conductive substrate is formed from an electrically conductive material. An example of the conductive substrate is a conductive substrate formed from an electrically conductive material. Another example of the conductive substrate is a conductive substrate coated with an electrically conductive material. Examples of electrically conductive materials include aluminum, iron, copper, tin, platinum, silver, vanadium, molybdenum, chromium, cadmium, titanium, nickel, palladium, indium, stainless steel, and brass. One of these electrically conductive materials may be used alone, or two or more of these electrically conductive materials may be used in combination (for example, as an alloy). Among the above-listed electrically conductive materials, aluminum and aluminum alloys are preferable in terms of favorable charge mobility from the photosensitive layer to the conductive substrate.

The shape of the conductive substrate is appropriately selected according to structure of the image forming apparatus. Examples of shapes of the conductive substrate include a sheet-like shape and a drum-like shape. The thickness of the conductive substrate is appropriately selected according to the shape of the conductive substrate.

<Intermediate Layer>

The intermediate layer (undercoat layer) contains for example inorganic particles and a resin for intermediate layer use (intermediate layer resin). The presence of the intermediate layer is thought to cause a smooth flow of electric current generated upon irradiation of the photosensitive layer with light while insulation is maintained to such an extent that leakage current is prevented, resulting in suppression of an increase in resistance.

Examples of inorganic particles include particles of metals (specific examples include aluminum, iron, and copper), particles of metal oxides (specific examples include titanium oxide, alumina, zirconium oxide, tin oxide, and zinc oxide), and particles of non-metal oxides (specific examples include silica). One type of these inorganic particles may be used alone, or two or more types of these inorganic particles may be used in combination.

Examples of the intermediate layer resin are the same as the above-listed examples of the binder resins. The intermediate layer may contain an additive. Examples of additives that may be contained in the intermediate layer are the same as the examples of additives that may be contained in the charge generating layer and the charge transport layer.

<Method for Producing Photosensitive Member>

The following describes an example of methods for producing the photosensitive member. The method for producing the photosensitive member includes formation of the charge generating layer and formation of the charge transport layer.

In formation of the charge generating layer, an application liquid to be used for formation of the charge generating layer (hereinafter may be referred to as an application liquid for charge generating layer formation) is prepared. The application liquid for charge generating layer formation is applied onto the conductive substrate. Then, at least a portion of a solvent contained in the applied application liquid for charge generating layer formation is removed to form the charge generating layer. The application liquid for charge generating layer formation contains for example a charge generating material, a base resin, and the solvent. Such an application liquid for charge generating layer formation is prepared by dissolving or dispersing the charge generating material and the base resin in the solvent. An additive may be added to the application liquid for charge generating layer formation as necessary.

In formation of the charge transport layer, an application liquid to be used for formation of the charge transport layer (hereinafter may be referred to as an application liquid for charge transport layer formation) is prepared. The application liquid for charge transport layer formation is applied onto the charge generating layer. Then, at least a portion of a solvent contained in the applied application liquid for charge transport layer formation is removed to form the charge transport layer. The application liquid for charge transport layer formation contains the compound (1), a binder resin, an electron acceptor compound, and the solvent. The application liquid for charge transport layer formation can be prepared by dissolving or dispersing the compound (1), the binder resin, and the electron acceptor compound in the solvent. An additive may be added to the application liquid for charge transport layer formation as necessary.

No specific limitation is placed on the solvent contained in the application liquid for charge generating layer formation and the solvent contained in the application liquid for charge transport layer formation (hereinafter may each be referred to as an application liquid) as long as components contained in the respective application liquids can be dissolved or dispersed therein. Examples of the solvents include alcohols (specific examples include methanol, ethanol, isopropanol, and butanol), aliphatic hydrocarbons (specific examples include n-hexane, octane, and cyclohexane), aromatic hydrocarbons (specific examples include benzene, toluene, and xylene), halogenated hydrocarbons (specific examples include dichloromethane, dichloroethane, carbon tetrachloride, and chlorobenzene), ethers (specific examples include dimethyl ether, diethyl ether, tetrahydrofuran, ethylene glycol dimethyl ether, and diethylene glycol dimethyl ether), ketones (specific examples include acetone, methyl ethyl ketone, and cyclohexanone), esters (specific examples include ethyl acetate and methyl acetate), dimethyl formaldehyde, dimethyl formamide, and di methyl sulfoxide. One of these solvents may be used alone, or two or more of these solvents may be used in combination. Non-halogenated solvents (solvents other than halogenated hydrocarbons) among the above-listed solvents are preferably used.

Preferably, the solvent contained in the application liquid for charge transport layer formation differs from the solvent contained in the application liquid for charge generating layer formation. This is because it is preferable that the charge generating layer does not dissolve in the solvent contained in the application liquid for charge transport layer formation when the application liquid for charge transport layer formation is applied onto the charge generating layer.

Each of the application liquids is prepared by mixing the respective components for dispersion in a corresponding one of the solvents. Mixing or dispersion can be performed for example using a bead mill, a roll mill, a ball mill, an attritor, a paint shaker, or an ultrasonic disperser.

In order to improve dispersibility of the respective components or improve surface smoothness of the respective layers to be formed, the application liquids may contain for example a surfactant or a leveling agent.

No specific limitation is placed on an application method for the application liquid as long as the application liquid can be uniformly applied. Examples of the application method include dip coating, spray coating, spin coating, and bar coating.

No specific limitation is placed on a removal method for removing at least a portion of the solvent contained in the application liquid as long as the solvent can be evaporated. Examples of the removal method include heating, depressurization, and a combination of heating and depressurization. More specific examples of the removal method include thermal treatment (hot-air drying) using a high-temperature dryer or a reduced pressure dryer. The thermal treatment is performed for example at a temperature of at least 40° C. and no higher than 150° C. The thermal treatment is performed for example for at least 3 minutes and no longer than 120 minutes.

The method for producing the photosensitive member may further include either or both of formation of the intermediate layer and formation of the protective layer as necessary. A known process can be appropriately adopted in formation of the intermediate layer and formation of the protective layer.

EXAMPLES

The following describes the present disclosure more specifically using examples. However, the present disclosure is by no means limited within the scope of the examples.

A charge generating material described below was prepared as a material for forming charge generating layers of photosensitive members. Hole transport materials, binder resins, and electron acceptor compounds described below were prepared as materials for forming charge transport layers of photosensitive members.

(Charge Generating Material)

Y-form titanyl phthalocyanine represented by chemical formula (CGM-2) described in the above embodiment was prepared as the charge generating material.

(Electron Acceptor Compound)

The compounds (20-E1), (20-E2), (21-E3), (22-E4), (23-E5), and (24-E6) described in the above embodiment were prepared as the electron acceptor compounds.

(Hole Transport Material)

The compounds (1-1) to (1-3) described in the above embodiment were prepared as the hole transport materials.

Also, compounds represented by chemical formulas (HTM-4), (HTM-5), (HTM-6), (HTM-7), (HTM-8), (HTM-9), and (HTM-10) (hereinafter may be referred to as compounds (HTM-4), (HTM-5), (HTM-6), (HTM-7), (HTM-8), (HTM-9), and (HTM-10), respectively) were prepared as hole transport materials to be used in comparative examples.

(HTM-4)

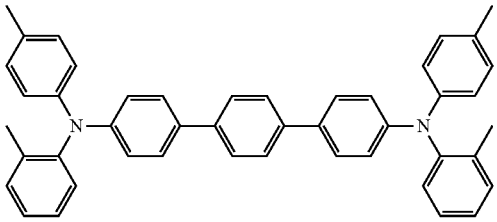

(HTM-5)

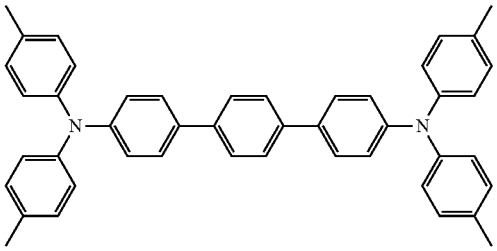

(HTM-6)

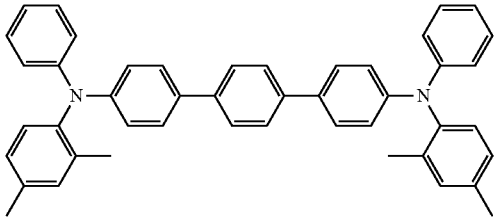

(HTM-7)

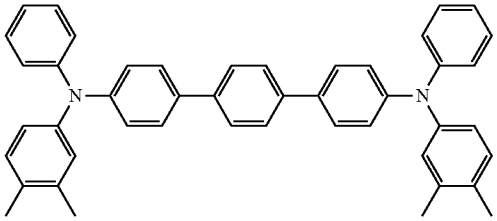

(HTM-8)

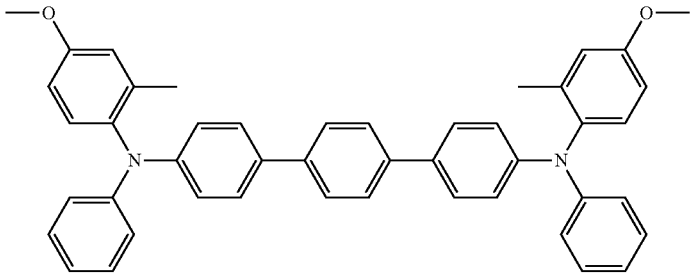

(HTM-9)

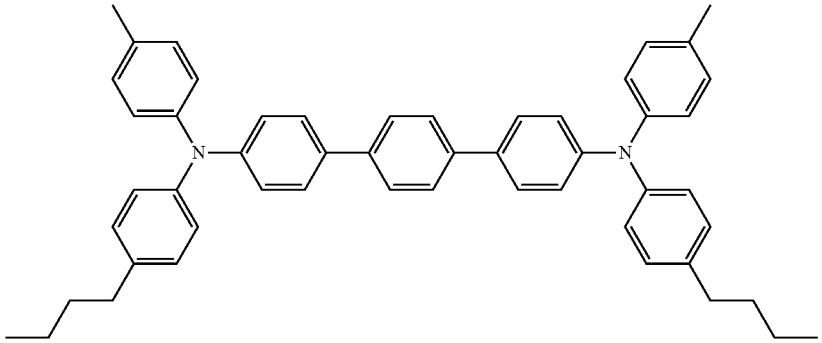

-continued (HTM-10)

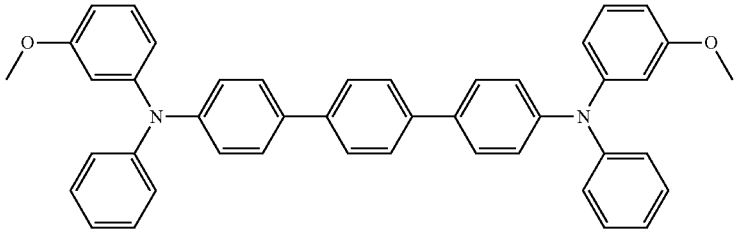

(Binder Resin)

The resins (R-1) to (R-8) described in the above embodiment were prepared as the binder resins.

(Resin (R-1))

The resin (R-1) was a polyarylate resin including only the repeating units (10-1), (11-X1), and (11-X3) as repeating units. The resin (R-1) included the repeating units (11-X1) and (11-X3) as two types of repeating units (11), and the ratio p was 0.50. The resin (R-1) had a viscosity average molecular weight of 50,500.

(R-1)

(10-1)

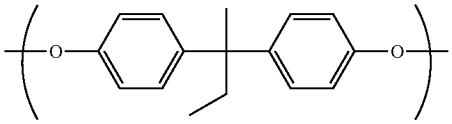

(11-X1)

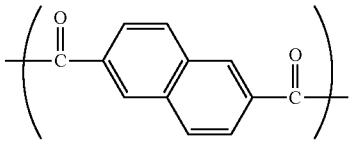

p = 0.50

(11-X3)

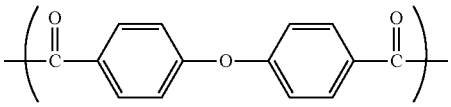

The resin (R-1) was synthesized by the following method. Specifically, a 1-L three-necked flask equipped with a thermometer, a three-way cock, and a 200-mL dripping funnel was used as a reaction vessel. First, 10 g (41.28 mmol) of the compound (BP-10-1), 0.062 g (0.413 mmol) of tert-butylphenol, 3.92 g (98 mmol) of sodium hydroxide, and 0.120 g (0.384 mmol) of benzyltributylammonium chloride were added into the reaction vessel. The air within the reaction vessel was replaced by argon gas. Then, 300 mL of water was added to the vessel contents. The vessel contents were stirred for one hour at 50° C. Then, the vessel contents were cooled to 10° C. Through the above, an alkaline aqueous solution A was obtained.

Separately, 4.10 g (16.2 mmol) of 2,6-naphthalene dicarboxylic acid dichloride (dichloride of the compound (DC-11-X1)) and 4.78 g (16.2 mmol) of 4,4'-oxybis benzoic acid dichloride (dichloride of the compound (DC-11-X3)) were dissolved in 150 mL of chloroform. Through the above, a chloroform solution B was obtained.

The chloroform solution B was gradually dripped into the alkaline aqueous solution A over 110 minutes using the dripping funnel. The vessel contents were stirred for four hours while the temperature of the vessel contents (liquid temperature) was controlled at 15±5° C. to cause polymerization reaction to proceed. Next, an upper layer (water phase) of the vessel contents was removed through decantation to obtain an organic phase. Then, 400 mL of ion exchanged water was added into a 1-L conical flask. The obtained organic phase was added to the flask contents. Further, 400 mL of chloroform and 2 mL of acetic acid were added to the flask contents. Then, the flask contents were stirred for 30 minutes at room temperature (25° C.). Thereafter, an upper layer (water phase) of the vessel contents was removed through decantation to obtain an organic phase. The obtained organic phase was washed with 1 L of ion exchanged water using a separatory funnel. Washing with ion exchanged water was repeated five times to obtain a washed organic phase.

Next, the washed organic phase was filtered to obtain a filtrate. Further, 1 L of methanol was added into a 1-L beaker. The obtained filtrate was gradually dripped into methanol in the beaker to obtain a precipitate. The precipitate was collected through filtration. The collected precipitate was dried under a vacuum for 12 hours at 70° C. As a result, the resin (R-1) was obtained.

(Resin (R-2))

The resin (R-2) was a polyarylate resin including only the repeating units (10-2), (11-X1), and (11-X3) as repeating units. The resin (R-2) included the repeating units (11-X1) and (11-X3) as two types of repeating units (11), and the ratio p was 0.50. The resin (R-2) had a viscosity average molecular weight of 47,500.

(R-2)

(10-2)

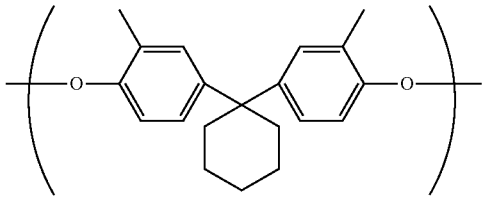

(11-X1)

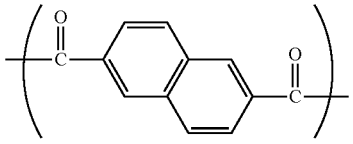

p = 0.50

-continued (11-X3)

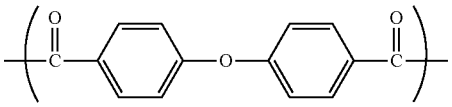

The resin (R-2) was synthesized by the following method. Specifically, the resin (R-2) was obtained by the same method as that for synthesis of the resin (R-1) in all aspects other than that 41.28 mmol of the compound (BP-10-2) was used instead of 41.28 mmol of the compound (BP-10-1).

(Resin (R-3))

The resin (R-3) was a polyarylate resin including only the repeating units (10-2), (11-X1), and (11-X2) as repeating units. The resin (R-3) included the repeating units (11-X1) and (11-X2) as two types of repeating units (11), and the ratio p was 0.50. The resin (R-3) had a viscosity average molecular weight of 50,500.

(R-3)

(10-2)

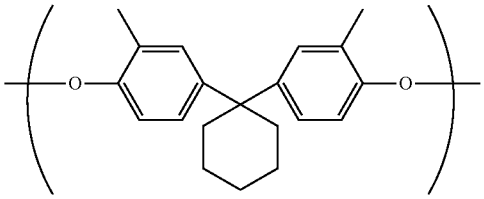

(11-X1)

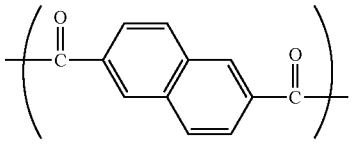

p = 0.50

(11-X2)

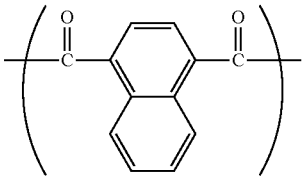

The resin (R-3) was synthesized by the following method. Specifically, the resin (R-3) was obtained by the same method as that for synthesis of the resin (R-1) in all aspects other than that 41.28 mmol of the compound (BP-10-2) was used instead of 41.28 mmol of the compound (BP-10-1), and 16.2 mmol of dichloride of the compound (DC-11-X2) was used instead of 16.2 mmol of dichloride of the compound (DC-11-X3).

(Resin (R-8))

The resin (R-8) was a polyarylate resin including only the repeating units (10-4) and (11-X3) as repeating units. The resin (R-8) had a viscosity average molecular weight of 50,900.

(R-8)

(10-4)

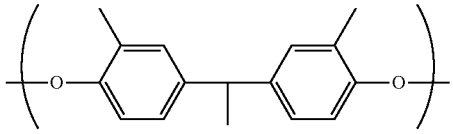

(11-X3)

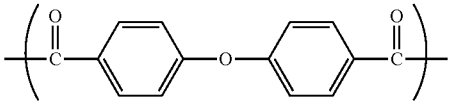

The resin (R-8) was synthesized by the following method. Specifically, the resin (R-8) was obtained by the same method as that used in synthesis of the resin (R-1) in all aspects other than that 41.28 mmol of the compound (BP-10-4) was used instead of 41.28 mmol of the compound (BP-10-1), and 32.4 mmol of dichloride of the compound (DC-11-X3) was used instead of 16.2 nmol of dichloride of the compound (DC-11-X1) and 16.2 mmol of dichloride of the compound C-11-X3).

(Resin (R-4))

The resin (R-4) was a polyarylate resin including only the repeating units (10-3), (11-X1), and (11-X3) as repeating units. The resin (R-4) included the repeating units (11-X1) and (11-X3) as two types of repeating units (11), and the ratio p was 0.50. The resin (R-4) had a viscosity average molecular weight of 55,000.

(R-4)

(10-3)

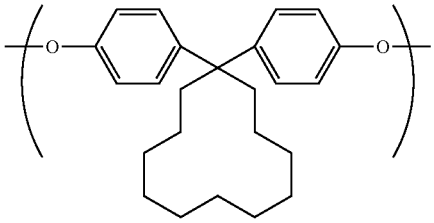

(11-X1)

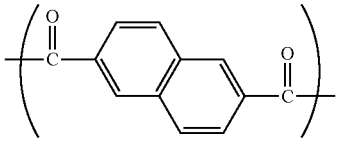

p = 0.50

(11-X3)

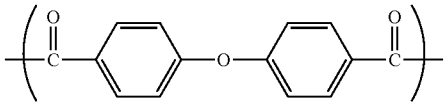

The resin (R-4) was synthesized by the following method. Specifically, a 2-L three-necked flask equipped with a thermometer, a three-way cock, and a 400-mL dripping funnel was used as a reaction vessel. First, 29.10 g (82.56 mmol) of the compound (BP-10-3), 0.124 g (0.826 mmol) of tert-butylphenol, 7.84 g (196 mmol) of sodium hydroxide, and 0.240 g (0.768 mmol) of benzy chloride were added into the reaction vessel. The air within the reaction vessel was replaced by argon gas. Then, 600 mL of water was added to the vessel contents. The vessel contents were stirred for one hour at 20° C. Then, the vessel contents were cooled to 10° C. Through the above, an alkaline aqueous solution C was obtained.

Further, 9.84 g (38.9 mmol) of 2,6-naphthalene dicarboxylic acid dichloride (dichloride of the compound (DC-11-X1)) and 11.47 g (38.9 mmol) of 4,4'-oxybis benzoic acid dichloride (dichloride of the compound (DC-11-X3)) were dissolved in 300 mL of chloroform. Through the above, a chloroform solution D was obtained.

The chloroform solution D was gradually dripped into the alkaline aqueous solution C over 110 minutes using the dripping funnel. The vessel contents were stirred for three hours while the temperature of the vessel contents (liquid temperature) was controlled at 13±3° C. to cause polymerization reaction to proceed. Next, an upper layer (water phase) of the vessel contents was removed through decantation to obtain an organic phase. Then, 500 mL of ion exchanged water was added into a 2-L conical flask. The obtained organic phase was added to the flask contents. Further, 300 mL of chloroform and 6 mL of acetic acid were added to the flask contents. Next, the flask contents were stirred for 30 minutes at room temperature (25° C.). Thereafter, an upper layer (water phase) of the vessel contents was removed through decantation to obtain an organic phase. The obtained organic phase was washed with 500 mL of ion exchanged water using a separatory funnel. Washing with ion exchanged water was repeated five times to obtain a washed organic phase.

Next, the washed organic phase was filtered to obtain a filtrate. Further, 1.5 L of methanol was added into a 3-L beaker. The obtained filtrate was gradually dripped into methanol in the beaker to obtain a precipitate. The precipitate was collected through filtration. The collected precipitate was dried under a vacuum for 12 hours at 70° C. As a result, the resin (R-4) was obtained.

(Resin (R-5))

The resin (R-5) was a polycarbonate resin including only the repeating unit (R-5) as a repeating unit. The resin (R-5) had a viscosity average molecular weight of 50,600.

(R-5)

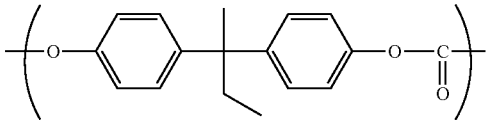

(Resin (R-6))

The resin (R-6) was a polycarbonate resin including only the repeating unit (R-6) as a repeating unit. The resin (R-6) had a viscosity average molecular weight of 49,400.

(R-6)

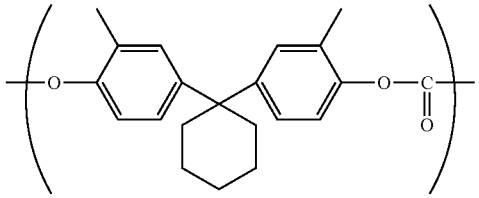

(Resin (R-7))

The resin (R-7) was a polycarbonate resin including only the repeating unit (R-7) as a repeating unit. The resin (R-7) had a viscosity average molecular weight of 50,900.

(R-7)

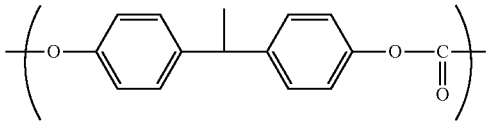

Next, $^1$H-NMR spectra of the synthesized resins (R-1) to (R-4) were measured using a proton nuclear magnetic resonance spectrometer (product of JASCO Corporation, 300 MHz). $CDCl_3$ was used as a solvent. Tetramethylsilane (TMS) was used as an internal standard sample. Chemical shift values of the resins (R-1) and (R-4) as representative resins of the resins (R-1) to (R-4) are shown below. It was confirmed from the chemical shift values that the resins (R-1) and (R-4) were obtained. It was also confirmed that the resins (R-2) and (R-3) were obtained by the same method.

Resin (R-1): $^1$H-NMR (300 MHz, $CDCl_3$) δ=8.85 (s, 2H), 8.29 (d, 2H), 8.23 (dd, 4H), 8.12 (d, 2H), 7.04-7.24 (m, 16H), 2.16 (q, 4H), 1.65 (s, 6H), 0.78 (t, 6H).

Resin (R-4): $^1$H-NMR (300 MHz, $CDCl_3$) δ=8.84 (s, 2H), 8.28 (d, 2H), 8.22 (d, 4H), 8.11 (d, 2H), 7.10-7.31 (m, 20H), 2.12 (brs, 8H), 1.38 (brs, 28H), 1.00 (brs, 8H).

<Production of Photosensitive Member>

Photosensitive members (A-1) to (A-26) and (B-1) to (B-8) were produced using the above-described charge generating material, hole transport materials, binder resins, and electron acceptor compounds.

(Production of Photosensitive Member (A-1))

First, an intermediate layer was formed. Surface-treated titanium oxide ("sample product SMT-A" manufactured by TAYCA CORPORATION, number average primary particle diameter: 10 nm) was prepared. SMT-A was obtained by surface treating titanium oxide, which had been surface-treated with alumina and silica, with methyl hydrogen polysiloxane under wet dispersion. Next, SMT-A (2 parts by mass) and a polyamide resin ("AMILAN (registered Japanese trademark) CM8000" manufactured by Toray Industries, Inc., a four-component polyamide resin of polyamide 6, polyamide 12, polyamide 66, and polyamide 610, 1 part by mass) were added to a solvent including methanol (10 parts by mass), butanol (1 part by mass), and toluene (1 part by mass). These materials and the solvent were mixed for five hours using a bead mill to disperse the materials in the solvent. Through the above, an application liquid for intermediate layer formation was prepared. The obtained application liquid for intermediate layer formation was filtered using a filter having a pore size of 5 μm. Thereafter, the application liquid for intermediate layer formation was applied onto a surface of a conductive substrate by dip coating. The conductive substrate used was an aluminum drum-shaped support (diameter: 30 mm, entire length: 246 mm). Subsequently, the applied application liquid for intermediate layer formation was dried for 30 minutes at 130° C. to form an intermediate layer (film thickness: 2 μm) on the conductive substrate.

Next, a charge generating layer was formed. Specifically, Y-form titanyl phthalocyanine (1.5 parts by mass) and a polyvinyl acetal resin ("S-LEC BX-5" manufactured by Sekisui Chemical Co., Ltd., 1 part by mass) as a base resin were added to a solvent including propylene glycol monomethyl ether (40 parts by mass) and tetrahydrofuran (40 parts by mass). These materials and the solvent were mixed for two hours using a bead mill to disperse the materials in the solvent. Through the above, an application liquid for charge generating layer formation was prepared. The obtained application liquid for charge generating layer formation was filtered using a filter having a pore size of 3 μm. Then, the resultant filtrate was applied onto the intermediate layer by dip coating and dried for five minutes at 50° C. Through the above, the charge generating layer (film thickness: 0.3 μm) was formed on the intermediate layer.

Next, a charge transport layer was formed. Specifically, 60.0 parts by mass of the compound (1-1) as a hole transport material, 100.0 parts by mass of the resin (R-1) as a binder resin, 10.0 parts by mass of the compound (20-E1) as an electron acceptor compound, 0.5 parts by mass of a hindered phenol antioxidant ("IRGANOX (registered Japanese trademark) 1010" manufactured by BASF), and 0.05 parts by mass of a leveling agent (dimethyl silicone oil, "KF96-50CS" manufactured by Shin-Etsu Chemical Co., Ltd.) were added to a solvent including 350.0 parts by mass of tetrahydrofuran and 350.0 parts by mass of toluene. These materials and the solvent were mixed to disperse the materials in the solvent. Through the above, an application liquid for charge transport layer formation was prepared. The obtained application liquid for charge transport layer formation was applied onto the charge generating layer by dip coating and dried for 40 minutes at 120° C. Through the above, the charge transport layer (film thickness: 20 μm) was formed on the charge generating layer. As a result, the photosensitive member (A-1) was obtained. In the photosensitive member (A-1), the intermediate layer was disposed on the conductive substrate, the charge generating layer was disposed on the intermediate layer, and the charge transport layer was disposed on the charge generating layer.

(Production of Photosensitive Members (A-2) to (A-26) and (B-1) to B-8))

The photosensitive members (A-2) to (A-26) and (B-1) to (B-8) were each produced by the same method as that for production of the photosensitive member (A-1) in all aspects other than the following changes. In production of the photosensitive member (A-1), 60.0 parts by mass of the compound (1-1) was used as the hole transport material. In production of the photosensitive members (A-2) to (A-26) and (B-1) to (B-8), hole transport materials of the types and the amounts indicated in Tables 1 to 4 were used. In production of the photosensitive member (A-1), the resin (R-1) was used as the binder resin. In production of the photosensitive members (A-2) to (A-26) and (B-1) to (B-8), binder resins of the types indicated in Tables 1 to 4 were used. In production of the photosensitive member (A-1), 10.0 parts by mass of the compound (20-E1) was used as the electron acceptor compound. In production of the photosensitive members (A-2) to (A-26) and (B-1) to (B-8), electron acceptor compounds of the types and the amounts indicated in Tables 1 to 4 were used.

<Evaluation of Electrical Characteristics>

Charge characteristics and sensitivity characteristics were evaluated as electrical characteristics of the photosensitive members.

<Evaluation of Charge Characteristics>

Charge characteristics were evaluated for each of the photosensitive members (A-1) to (A-26) and (B-1) to (B-8) in an environment at a temperature of 10° C. and a relative humidity of 20%. Specifically, each photosensitive member was charged using a drum sensitivity test device (product of Gen-Tech, Inc.) under the following conditions. A rotational speed of the photosensitive member was 31 rpm and electric current flowing into the photosensitive member was −10 μA. A surface potential of the charged photosensitive member was measured. The measured surface potential was determined as a charge potential ($V_0$, unit: −V) of the photosensitive member. Tables 1 to 4 show the charge potential ($V_0$) for each of the photosensitive members.

(Evaluation of Sensitivity Characteristics)

Sensitivity characteristics were evaluated for each of the photosensitive members (A-1) to (A-26) and (B-1) to (B-8) in an environment at a temperature of 10° C. and a relative humidity of 20%. Specifically, a surface of each photosensitive member was charged to −600 V using a drum sensitivity test device (product of Gen-Tech, Inc.). Then, monochromatic light (wavelength: 780 nm, light exposure amount: 0.26 μJ/cm$^2$) was taken out of light of a halogen lamp using a bandpass filter and the surface of the photosensitive member was irradiated with the monochromatic light. A surface potential of the photosensitive member was measured when 50 milliseconds elapsed from completion of irradiation with the monochromatic light. The measured surface potential was determined as a post-exposure electric potential ($V_L$, unit: −V) of the photosensitive member. Tables 1 to 4 show the post-exposure electric potential ($V_L$) for each of the photosensitive members. A smaller absolute value of the post-exposure electric potential ($V_L$) indicates superior sensitivity characteristics of the photosensitive member. Sensitivity characteristics of a photosensitive member for which an absolute value of the post-exposure electric potential ($V_L$) was equal to or greater than 130 V were evaluated as poor (indicated as "NG" in Table 4).

<Evaluation of Inhibition of Crystallization=

An overall region of the photosensitive layer of each of the photosensitive members (A-1) to (A-26) and (B-1) to (B-8) was visually observed. Through the observation, the presence or absence of a crystallized part in the photosensitive layer was determined. Based on a result of the determination, whether or not crystallization was inhibited was evaluated according to the following evaluation criteria. Tables 1 to 4 show evaluation results. For a photosensitive member of which the evaluation result was C or D, inhibition of crystallization of the photosensitive layer was evaluated as poor (indicated as "NG" in Table 4).

(Evaluation Criteria for Inhibition of Crystallization)

A: No crystallized part was observed.

B: A clouded part was observed, but no crystallized part was observed.

C: A crystallized part was slightly observed.

D: A crystallized part was clearly observed.

<Evaluation of Oil Crack Resistance>

Oil crack resistance was evaluated for each of the photosensitive members (A-1) to (A-26) and (B-1) to (B-8). Specifically, a portion of each photosensitive member from its lower end to a height of 40 mm was soaked in an isoparaffin-based hydrocarbon solvent ("ISOPAR L" manufactured by Exxon Mobil Corporation) for 24 hours in an environment at a temperature of 23° C. and a relative humidity of 50%. After the soak for 24 hours, the number of cracks generated in a surface of the photosensitive member was counted. Oil crack resistance was evaluated based on the number of cracks according to the following criteria. For a photosensitive member of which a result the evaluation was C or D, oil crack resistance was evaluated as poor (indicated as "NG" in Table 4).

(Evaluation Criteria for Oil Crack Resistance)

A: No crack was observed.

B: The number of cracks was at least 1 and no greater than 20.

C: The number of cracks was at least 21 and no greater than 100.

D: The number of cracks was greater than 100.

In Tables 1 to 4, "HTM", "Resin", "EA", "Part", "$V_0$" and "$V_L$" represent hole transport material, binder resin, electron acceptor compound, parts by mass, charge potential, and post-exposure electric potential, respectively. In Tables 1 to 4, "-" indicates that oil crack resistance was not evaluated since an evaluation result for inhibition of crystallization was D.

In Tables 1 to 4, "HTM/Resin" represents a ratio $m_{HTM}/m_{Resin}$ of the mass $m_{HTM}$ of the hole transport material to the mass $m_{Resin}$ of the binder resin.

The ratio $m_{HTM}/m_{Resin}$ was calculated by the following expression: ratio $m_{HTM}/m_{Resin}$=amount of hole transport material (unit: parts by mass)/amount of binder resin (unit: parts by mass).

In Tables 1 to 4, "EA/HTM" represents a ratio $m_{EA}/m_{HTM}$ of the mass $m_{EA}$ of the electron acceptor compound to the mass $m_{HTM}$ of the hole transport material. The ratio $m_{EA}/m_{HTM}$ was calculated by the following expression: ratio $m_{EA}/m_{HTM}$=amount of electron acceptor compound (unit: parts by mass)/amount of hole transport material (unit: parts by mass).

TABLE 1

| | | Charge transport layer | | | | | | | | Electrical characteristics | | | |
|---|---|---|---|---|---|---|---|---|---|---|---|---|---|
| | Photo- | HTM | | Resin | | EA | | | | Charge characteristics | Sensitivity characteristics | Inhibition | Oil crack |
| | sensitive member | Type | Amount [Part] | Type | Amount [Part] | Type | Amount [Part] | HTM/Resin | EA/HTM | $V_0$ [−V] | $V_L$ [−V] | of crystallization | resistance |
| Example 1 | A-1 | 1-1 | 60.0 | R-1 | 100.0 | 20-E1 | 10.0 | 0.60 | 0.17 | 693 | 94 | A | A |
| Example 2 | A-2 | 1-2 | 60.0 | R-1 | 100.0 | 20-E1 | 10.0 | 0.60 | 0.17 | 680 | 90 | A | A |
| Example 3 | A-3 | 1-3 | 60.0 | R-1 | 100.0 | 20-E1 | 10.0 | 0.60 | 0.17 | 675 | 99 | A | A |
| Example 4 | A-4 | 1-1 | 40.0 | R-1 | 100.0 | 20-E1 | 6.7 | 0.40 | 0.17 | 687 | 120 | A | A |
| Example 5 | A-5 | 1-1 | 50.0 | R-1 | 100.0 | 20-E1 | 8.3 | 0.50 | 0.17 | 690 | 97 | A | A |
| Example 6 | A-6 | 1-1 | 80.0 | R-1 | 100.0 | 20-E1 | 13.3 | 0.80 | 0.17 | 701 | 85 | A | A |
| Example 7 | A-7 | 1-1 | 100.0 | R-1 | 100.0 | 20-E1 | 16.7 | 1.00 | 0.17 | 685 | 82 | A | A |
| Example 8 | A-8 | 1-1 | 60.0 | R-2 | 100.0 | 20-E1 | 10.0 | 0.60 | 0.17 | 695 | 95 | A | A |
| Example 9 | A-9 | 1-1 | 60.0 | R-3 | 100.0 | 20-E1 | 10.0 | 0.60 | 0.17 | 684 | 90 | A | A |
| Example 10 | A-10 | 1-1 | 60.0 | R-4 | 100.0 | 20-E1 | 10.0 | 0.60 | 0.17 | 680 | 96 | A | A |

TABLE 2

| | | Charge transport layer | | | | | | | | Electrical characteristics | | | |
|---|---|---|---|---|---|---|---|---|---|---|---|---|---|
| | Photo- | HTM | | Resin | | EA | | | | Charge characteristics | Sensitivity characteristics | Inhibition | Oil crack |
| | sensitive member | Type | Amount [Part] | Type | Amount [Part] | Type | Amount [Part] | HTM/Resin | EA/HTM | $V_0$ [−V] | $V_L$ [−V] | of crystallization | resistance |
| Example 11 | A-11 | 1-1 | 60.0 | R-5 | 100.0 | 20-E1 | 10.0 | 0.60 | 0.17 | 682 | 99 | A | A |
| Example 12 | A-12 | 1-1 | 60.0 | R-6 | 100.0 | 20-E1 | 10.0 | 0.60 | 0.17 | 693 | 93 | A | A |
| Example 13 | A-13 | 1-1 | 60.0 | R-7 | 100.0 | 20-E1 | 10.0 | 0.60 | 0.17 | 709 | 95 | B | A |
| Example 14 | A-14 | 1-1 | 60.0 | R-8 | 100.0 | 20-E1 | 10.0 | 0.60 | 0.17 | 687 | 93 | B | A |
| Example 15 | A-15 | 1-1 | 60.0 | R-1 | 100.0 | 20-E2 | 5.0 | 0.60 | 0.08 | 684 | 94 | A | A |
| Example 16 | A-16 | 1-1 | 60.0 | R-1 | 100.0 | 21-E3 | 10.0 | 0.60 | 0.17 | 687 | 90 | A | A |
| Example 17 | A-17 | 1-1 | 60.0 | R-1 | 100.0 | 22-E4 | 10.0 | 0.60 | 0.17 | 654 | 96 | A | A |
| Example 18 | A-18 | 1-1 | 60.0 | R-1 | 100.0 | 23-E5 | 10.0 | 0.60 | 0.17 | 674 | 98 | A | A |
| Example 19 | A-19 | 1-1 | 60.0 | R-1 | 100.0 | 24-E6 | 10.0 | 0.60 | 0.17 | 687 | 99 | A | A |
| Example 20 | A-20 | 1-1 | 60.0 | R-1 | 100.0 | 20-E1 | 0.6 | 0.60 | 0.01 | 680 | 90 | A | A |

TABLE 3

| | | Charge transport layer | | | | | | | | Electrical characteristics | | | |
|---|---|---|---|---|---|---|---|---|---|---|---|---|---|
| | Photo- | HTM | | Resin | | EA | | | | Charge characteristics | Sensitivity characteristics | Inhibition | Oil crack |
| | sensitive member | Type | Amount [Part] | Type | Amount [Part] | Type | Amount [Part] | HTM/Resin | EA/HTM | $V_0$ [−V] | $V_L$ [−V] | of crystallization | resistance |
| Example 21 | A-21 | 1-1 | 60 | R-1 | 100.0 | 20-E2 | 0.6 | 0.60 | 0.01 | 674 | 88 | A | A |
| Example 22 | A-22 | 1-1 | 60 | R-1 | 100.0 | 20-E1 | 6.0 | 0.60 | 0.10 | 684 | 95 | A | A |

TABLE 3-continued

| | Photo-sensitive member | Charge transport layer: HTM Type | HTM Amount [Part] | Resin Type | Resin Amount [Part] | EA Type | EA Amount [Part] | HTM/Resin | EA/HTM | Electrical characteristics: Charge characteristics $V_0$ [−V] | Sensitivity characteristics $V_L$ [−V] | Inhibition of crystallization | Oil crack resistance |
|---|---|---|---|---|---|---|---|---|---|---|---|---|---|
| Example 23 | A-23 | 1-1 | 60 | R-1 | 100.0 | 20-E1 | 30.0 | 0.60 | 0.50 | 681 | 108 | A | A |
| Example 24 | A-24 | 1-1 | 60 | R-1 | 100.0 | 20-E1 | 0.6 | 0.60 | 0.01 | 678 | 90 | A | A |
| Example 25 | A-25 | 1-1 | 60 | R-1 | 100.0 | 20-E1 | 18.0 | 0.60 | 0.30 | 669 | 98 | A | A |
| Example 26 | A-26 | 1-1 | 60 | R-1 | 100.0 | 20-E1 | 25.0 | 0.60 | 0.42 | 683 | 109 | A | B |

TABLE 4

| | Photo-sensitive member | Charge transport layer: HTM Type | HTM Amount [Part] | Resin type | Resin Amount [Part] | EA Type | EA Amount [Part] | HTM/Resin | EA/HTM | Electrical characteristics: Charge characteristics $V_0$ [−V] | Sensitivity characteristics $V_L$ [−V] | Inhibition of crystallization | Oil crack resistance |
|---|---|---|---|---|---|---|---|---|---|---|---|---|---|
| Comparative example 1 | B-1 | HTM-4 | 60.0 | R-1 | 100.0 | 20-E1 | 10.0 | 0.60 | 0.17 | 675 | 368 (NG) | D (NG) | — |
| Comparative example 2 | B-2 | HTM-5 | 60.0 | R-1 | 100.0 | 20-E1 | 10.0 | 0.60 | 0.17 | 676 | 500 (NG) | D (NG) | — |
| Comparative example 3 | B-3 | HTM-6 | 60.0 | R-1 | 100.0 | 20-E1 | 10.0 | 0.60 | 0.17 | 690 | 513 (NG) | D (NG) | — |
| Comparative example 4 | B-4 | HTM-7 | 60.0 | R-1 | 100.0 | 20-E1 | 10.0 | 0.60 | 0.17 | 692 | 482 (NG) | D (NG) | — |
| Comparative example 5 | B-5 | HTM-8 | 60.0 | R-1 | 100.0 | 20-E1 | 10.0 | 0.60 | 0.17 | 684 | 132 (NG) | A | A |
| Comparative example 6 | B-6 | HTM-9 | 60.0 | R-1 | 100.0 | 20-E1 | 10.0 | 0.60 | 0.17 | 683 | 130 (NG) | A | D (NG) |
| Comparative example 7 | B-7 | HTM-10 | 60.0 | R-1 | 100.0 | 20-E1 | 25.0 | 0.60 | 0.42 | 679 | 130 (NG) | A | C (NG) |
| Comparative example 8 | B-8 | 1-1 | 60.0 | R-1 | 100.0 | None | None | 0.60 | 0.00 | 689 | 90 | C (NG) | A |

The photosensitive members (A-1) to (A-26) each included a conductive substrate and a photosensitive layer. The photosensitive layer included a charge generating layer and a charge transport layer. The charge generating layer contained a charge generating material. The charge transport layer contained a hole transport material and a binder resin. The charge transport layer further contained an electron acceptor compound. Specifically, the charge transport layer contained the compound (20-E1), (20-E2), (21-E3), (22-E4), (23-E5), or (24-E6) as the electron acceptor compound. The hole transport material included the compound (1). Specifically, the charge transport layer contained the compound (1-1), (1-2), or (1-3) included in compounds represented by general formula (1) as the hole transport material. As a result, as shown in Tables 1 to 3, an absolute value of the post-exposure electric potential ($V_L$) was smaller than 130 V for each of the photosensitive members (A-1) to (A-26), which indicates that the photosensitive members (A-1) to (A-26) were excellent in electrical characteristics (particularly, sensitivity characteristics). Also, inhibition of crystallization was evaluated as A or B for each of the photosensitive members (A-1) to (A-26), which indicates that crystallization of the photosensitive layer was inhibited in the photosensitive members (A-1) to (A-26). Further, oil crack resistance was evaluated as A or B for each of the photosensitive members (A-1) to (A-26), which indicates that the photosensitive members (A-1) to (A-26) were excellent in oil crack resi stance.

By contrast, in each of the photosensitive members (B-1) to (B-7), the charge transport layer contained any of the compounds (HTM-4) to (HTM-10) as the hole transport material. However, none of the compounds (HTM-4) to (HTM-10) was a compound represented by general formula (1). As a result, as shown in Table 4, an absolute value of the post-exposure electric potential ($V_L$) was equal to or greater than 130 V for each of the photosensitive members (B-1) to (B-7), which indicates that the photosensitive members (B-1) to (B-7) were poor in electrical characteristics (particularly, sensitivity characteristics). Also, inhibition of crystallization was evaluated as D for each of the photosensitive members (B-1) to (B-4), which indicates that crystallization of the photosensitive layer was not inhibited in the photosensitive members (B-1) to (B-4). Further, oil crack resistance was evaluated as C or D for each of the photosensitive members (B-6) and (B-7), which indicates that the photosensitive members (B-6) and (B-7) were poor in oil crack resistance.

The charge transport layer of the photosensitive member (B-8) contained no electron acceptor compound. As a result, as shown in Table 4, inhibition of crystallization was evaluated as C for the photosensitive member (B-8), which indicates that crystallization of the photosensitive layer was not inhibited in the photosensitive member (B-8).

The above results show that improvement in electrical characteristics, inhibition of crystallization of the photosensitive layer, and improvement in oil crack resistance can be achieved in the photosensitive members according to the present disclosure.

What is claimed is:

1. An electrophotographic photosensitive member comprising a conductive substrate and a photosensitive layer, wherein the photosensitive layer includes a charge generating layer and a charge transport layer, the charge generating layer contains a charge generating material, the charge transport layer contains a hole transport material and a binder resin, the charge transport layer further contains an electron acceptor compound, and the hole transport material includes only a compound represented by a chemical formula (1-2), (1-2)

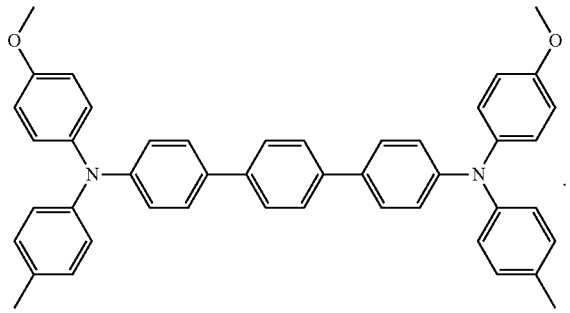

2. The electrophotographic photosensitive member according to claim 1, wherein a ratio of a mass of the hole transport material to a mass of the binder resin is at least 0.50.

3. The electrophotographic photosensitive member according to claim 1, wherein the binder resin includes a polyarylate resin, and the polyarylate resin includes at least one repeating unit represented by a general formula (10), a repeating unit represented by a chemical formula (11-X1), and at least one repeating unit represented by a general formula (11')

(10)

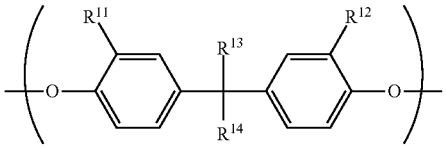

(11-X1)

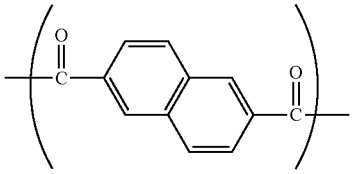

(11')

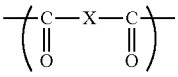

where in the general formula (10), $R^{11}$ and $R^{12}$ each represent, independently of each other, a hydrogen atom or a methyl group, and $R^{13}$ represents a hydrogen atom or an alkyl group having a carbon number of at least 1 and no greater than 4 and $R^{14}$ represents an alkyl group having a carbon number of at least 1 and no greater than 4, or $R^{13}$ and $R^{14}$ bond together to represent a cycloalkylidene group having a carbon number of at least 5 and no greater than 14, and X' in the general formula (11') represents a divalent group represented by a chemical formula (X2), (X3), (X4), (X5) or (X6)

(X2)

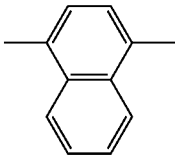

(X3)

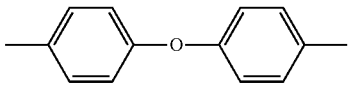

(X4)

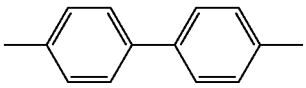

(X5)

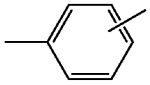

(X6)

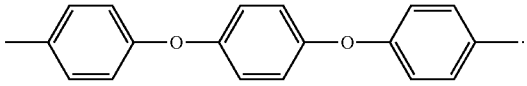

4. The electrophotographic photosensitive member according to claim 1, wherein the binder resin includes a polyarylate resin, and the polyarylate resin is a polyarylate resin including repeating units represented by chemical formulas (10-1), (11-X1), and (11-X3), (10-1)

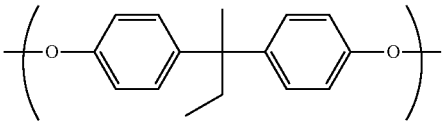

(11-X1)

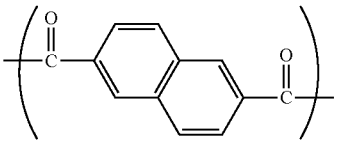

(11-X3)

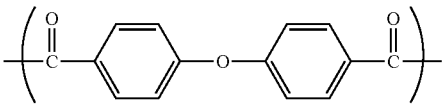

a polyarylate resin including repeating units represented by a chemical formula (10-2), the chemical formula (11-X1), and the chemical formula (11-X3), (10-2)

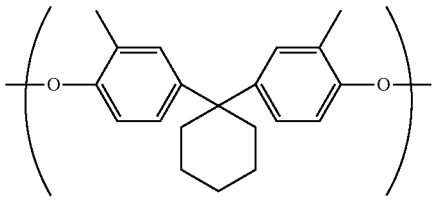

(11-X1)

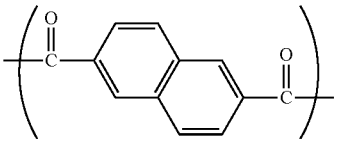

(11-X3)

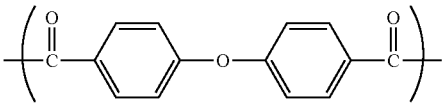

a polyarylate resin including repeating units represented by the chemical formula (10-2), the chemical formula (11-X1), and a chemical formula (11-X2), or (10-2)

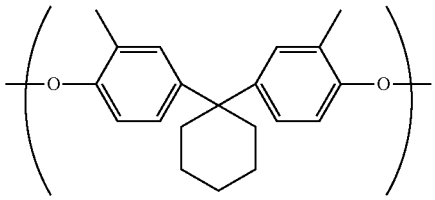

(11-X1)

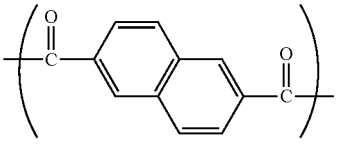

-continued (11-X2)

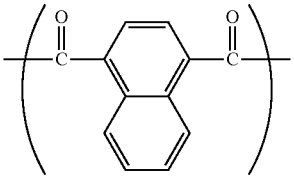

a polyarylate resin including repeating units represented by a chemical formula (10-3), the chemical formula (11-X1), and the chemical formula (11-X3)

(10-3)

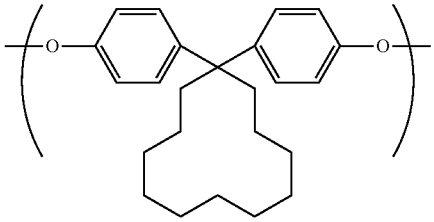

(11-X1)

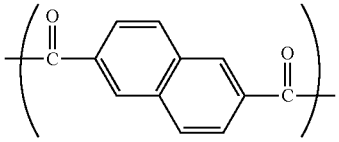

(11-X3)

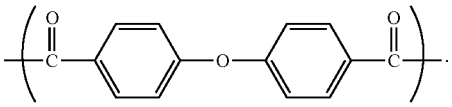

5. The electrophotographic photosensitive member according to claim 1, wherein the binder resin includes a polycarbonate resin, and the polycarbonate resin includes a repeating unit represented by a chemical formula (R-5) or (R-6)

(R-5)

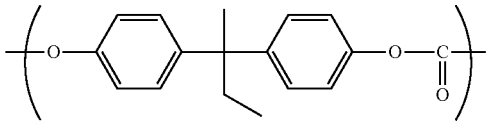

(R-6)

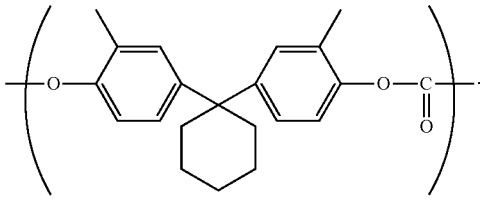

6. The electrophotographic photosensitive member according to claim 1, wherein a ratio of a mass of the electron acceptor compound to a mass of the hole transport material is at least 0.01 and no greater than 0.30.

7. The electrophotographic photosensitive member according to claim 1, wherein the electron acceptor compound includes a compound represented by a general formula (20), (21), (22), (23), or (24), (20)

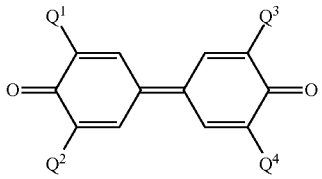

(21)

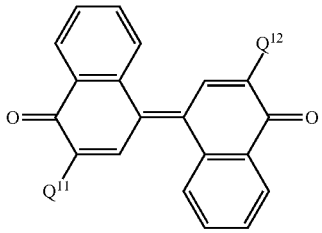

(22)

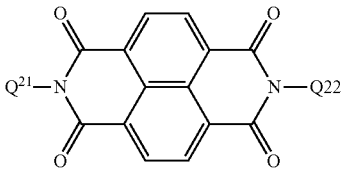

(23)

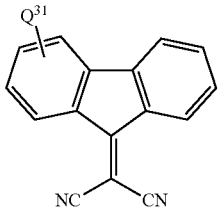

(24)

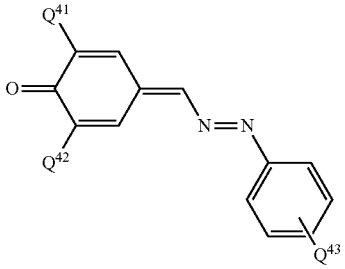

where in the general formula (20), $Q^1$, $Q^2$, $Q^3$, and $Q^4$ each represent, independently of one another, an alkyl group having a carbon number of at least 1 and no greater than 6, an alkoxy group having a carbon number of at least 1 and no greater than 6, a cycloalkyl group having a carbon number of at least 5 and no greater than 7, or an aryl group having a carbon number of at least 6 and no greater than 14, in the general formula (21), $Q^{11}$ and $Q^{12}$ each represent, independently of each other, an alkyl group having a carbon number of at least 1 and no greater than 6, an alkoxy group having a carbon number of at least 1 and no greater than 6, a cycloalkyl group having a carbon number of at least 5 and no greater than 7, or an aryl group having a carbon number of at least 6 and no greater than 14, in the general formula (22), $Q^{21}$ and $Q^{22}$ each represent, independently of each other, an aryl group having a carbon number of at least 6 and no greater than 14 and optionally having an alkyl group having a carbon number of at least 1 and no greater than 6 or an alkoxy group having a carbon number of at least 1 and no greater than 6, in the general formula (23), $Q^{31}$ represents an alkoxycarbonyl group having a carbon number of at least 2 and no greater than 7, and in the general formula (24), $Q^{41}$ and $Q^{42}$ each represent, independently of each other, an alkyl group having a carbon number of at least 1 and no greater than 6, and $Q^{43}$ represents a halogen atom.

8. The electrophotographic photosensitive member according to claim 1, wherein the electron acceptor compound includes a compound represented by a chemical formula (20-E1), (20-E2), (21-E3), (22-E4), (23-E5), or (24-E6)

(20-E1)

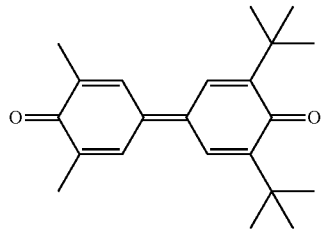

(20-E2)

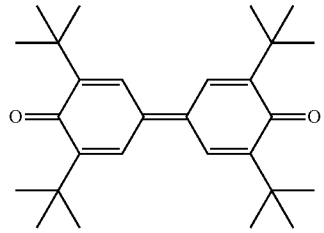

(21-E3)

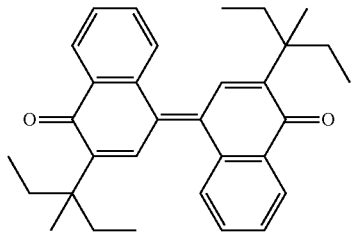

(22-E4)

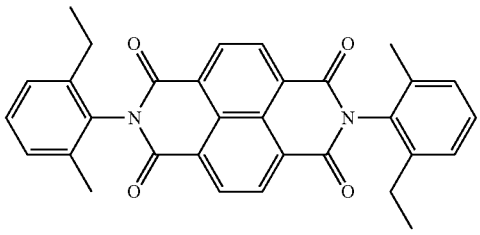

-continued (23-E5)

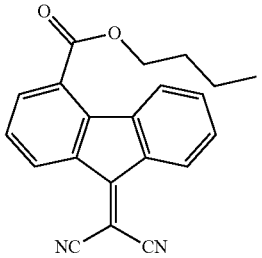

(24-E6)

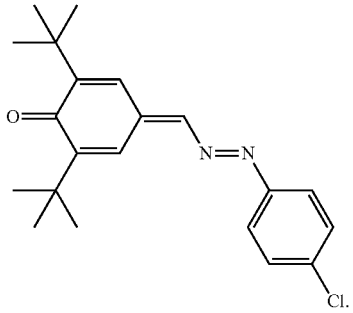

9. The electrophotographic photosensitive member according to claim 1, wherein the binder rein includes a polyarylate resin, and the polyarylate resin includes at least one repeating unit represented by a general formula (10), a repeating unit represented by a chemical formula (11-X1), and at least one repeating unit represented by a general formula (11'), (10)

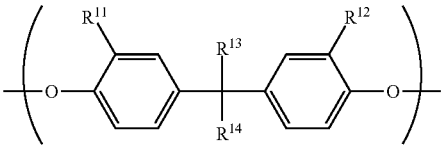

(11-X1)

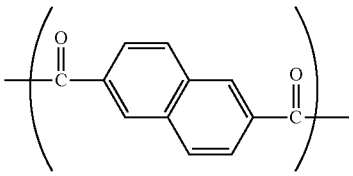

(11')

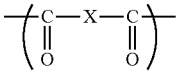

where in the general formula (10), $R^{11}$ and $R^{12}$ each represent, independently of each other, a hydrogen atom or a methyl group, and $R^{13}$ represents a hydrogen atom or an alkyl group having a carbon number of at least 1 and no greater than 4 and $R^{14}$ represents an alkyl group having a carbon number of at least 1 and no greater than 4, or $R^{13}$ and $R^{14}$ bond together to represent a cycloalkylidene group having a carbon number of at least 5 and no greater than 14, and X' in the general formula (11') represents a divalent group represented by a chemical formula (X2), (X2)

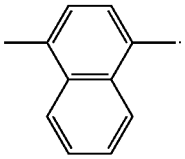

10. The electrophotographic photosensitive member according to claim 9, wherein the polyarylate resin includes repeating units represented by chemical formulas (10-2), (11-X1), and (11-X2), (10-2)

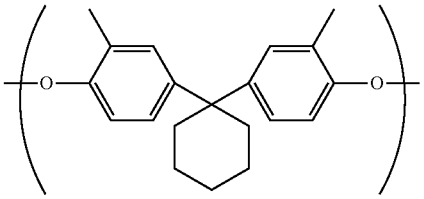

(11-X1)

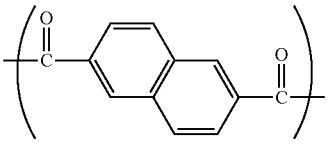

(11-X2)

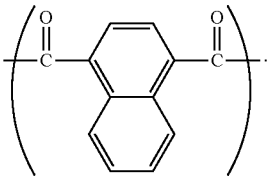

11. The electrophotographic photosensitive member according to claim 1, wherein the binder rein includes a polycarbonate resin, and the polycarbonate resin includes only a repeating unit represented by a chemical formula (R-6) as a repeating unit, (R-6)

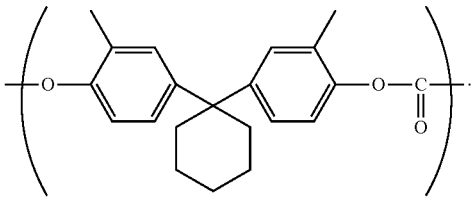

12. The electrophotographic photosensitive member according to claim 1, wherein the electron acceptor compound includes a compound represented by a general formula (22) or (23), (22)

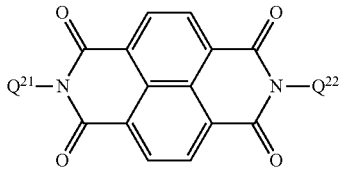

(23)

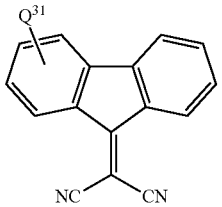

where in the general formula (22), $Q^{21}$ and $Q^{22}$ each represent, independently of each other, an aryl group having a carbon number of at least 6 and no greater than 14 and optionally having an alkyl group having a carbon number of at least 1 and no greater than 6 or an alkoxy group having a carbon number of at least 1 and no greater than 6, and in the general formula (23), $Q^{31}$ represents an alkoxycarbonyl group having a carbon number of at least 2 and no greater than 7.

13. The electrophotographic photosensitive member according to claim 12, wherein the compound represented by the general formula (22) is a compound represented by a chemical formula (22-E4), and the compound represented by the general formula (23) is a compound represented by a chemical formula (23-E5), (22-E4)

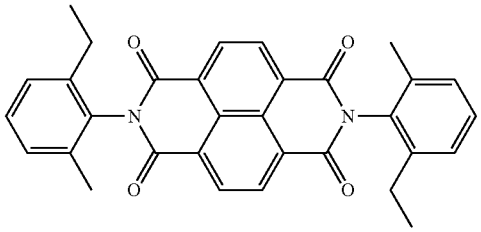

(23-E5)

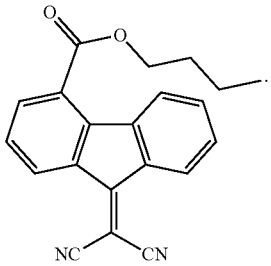

* * * * *